US009162441B1

(12) United States Patent
Noda

(10) Patent No.: US 9,162,441 B1
(45) Date of Patent: Oct. 20, 2015

(54) INKJET PRINTER AND METHOD

(71) Applicant: Brother Kogyo Kabushiki Kaisha, Nagoya-shi, Aichi-ken (JP)

(72) Inventor: Kengo Noda, Inazawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/670,473

(22) Filed: Mar. 27, 2015

(30) Foreign Application Priority Data

May 30, 2014 (JP) ..... 2014-113543

(51) Int. Cl.
*B41J 2/045* (2006.01)

(52) U.S. Cl.
CPC ..... *B41J 2/04503* (2013.01); *B41J 2/04586* (2013.01)

(58) Field of Classification Search
CPC .... B41J 11/005; B41J 2/04556; B41J 25/308; B41J 2/155; B41J 13/14; B41J 25/3082; B41J 2/04508
USPC ..... 347/8, 14, 15, 16, 19, 40, 41, 101, 104, 347/105
See application file for complete search history.

(56) References Cited

U.S. PATENT DOCUMENTS

| | | | | |
|---|---|---|---|---|
| 5,874,979 | A | 2/1999 | Ohyama | |
| 6,554,387 | B1 * | 4/2003 | Otsuki | 347/19 |
| 7,073,883 | B2 * | 7/2006 | Billow | 347/19 |
| 2008/0204495 | A1 | 8/2008 | Ueno et al. | |
| 2013/0135375 | A1 | 5/2013 | Kawagoe | |
| 2013/0257937 | A1 | 10/2013 | Arakane | |
| 2013/0257940 | A1 | 10/2013 | Terada | |

FOREIGN PATENT DOCUMENTS

| | | | |
|---|---|---|---|
| JP | 3507485 | B2 | 3/2004 |
| JP | 2008-230069 | A | 10/2008 |
| JP | 2009012448 | A | 1/2009 |
| JP | 2013-111939 | A | 6/2013 |
| JP | 2013-212585 | A | 10/2013 |
| JP | 2013-226801 | A | 11/2013 |

OTHER PUBLICATIONS

NPL—Specification, Claims, Abstract and Drawings, U.S. Appl. No. 14/670,517, filed Mar. 27, 2015.
Jun. 10, 2015—(US) Non-Final Office Action—U.S. Appl. No. 14/670,517.

* cited by examiner

*Primary Examiner* — Thinh Nguyen
(74) *Attorney, Agent, or Firm* — Banner & Witcoff, Ltd.

(57) ABSTRACT

An inkjet printer includes an inkjet head including nozzles arranged in a first direction, a head scanning mechanism moving the inkjet head along a second direction perpendicular to the first direction, a feeding mechanism feeding the recording medium along the first direction, and a storage device storing upstream correction information and downstream correction information. A controller performs a first determination process for determining a correction value for a specific scanning operation by using the upstream correction information when an image is printed on an upstream area adjacent to a specific area corresponding to the specific scanning operation and when no image is printed on a downstream area adjacent to the specific area, and a second determination process for determining the correction value by using the downstream correction information when no image is printed on the upstream area and when an image be printed on the downstream area.

20 Claims, 17 Drawing Sheets

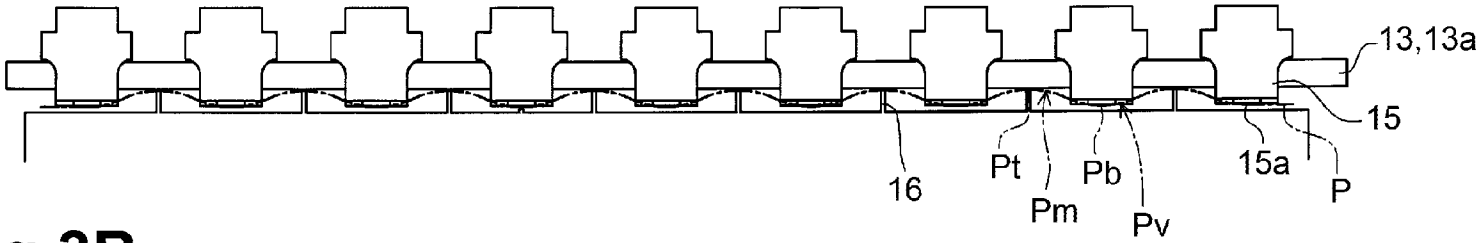
Fig.3A
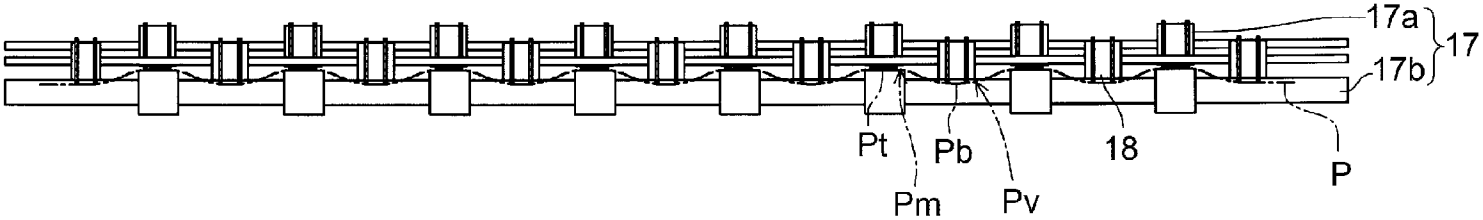
Fig.3B
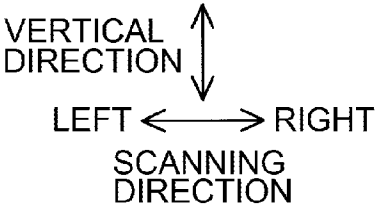

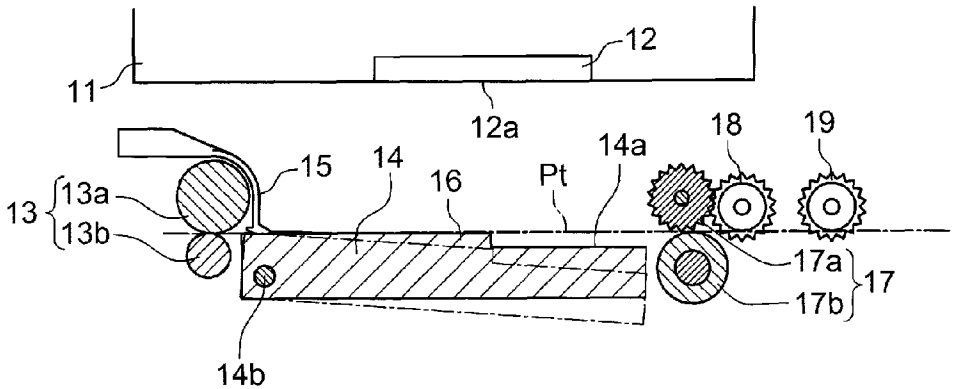
Fig.4A
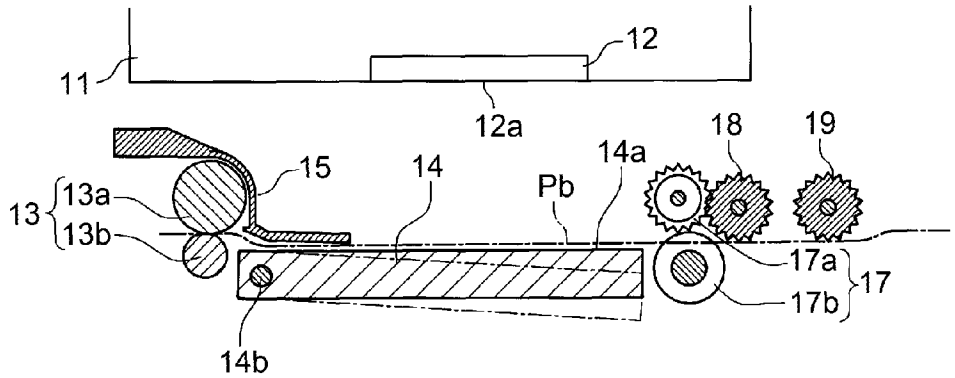
Fig.4B
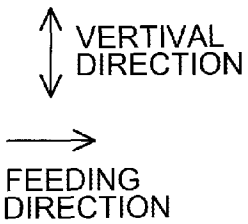

INKJET PRINTER AND METHOD

CROSS-REFERENCE TO RELATED APPLICATION

This application claims priority from Japanese Patent Application No. 2014-113543 filed on May 30, 2014, the content of which is incorporated herein by reference in its entirety.

FIELD OF DISCLOSURE

The disclosure relates to an inkjet printer configured to perform printing by ejecting ink from nozzles and a method.

BACKGROUND

A known inkjet recording apparatus, e.g., an inkjet printer, is configured to perform printing by ejecting ink from nozzles. The inkjet printer performs printing on a recording medium by ejecting ink from an inkjet head moving in a scanning direction while feeding a recording medium, which is corrugated along the scanning direction, in a feeding direction of the recording medium perpendicular to the scanning direction.

In the known inkjet printer, gaps between the nozzles and a recording medium are greater for the nozzles on the downstream side, in the feeding direction, of the inkjet head, than for the nozzles on the upstream side of the inkjet head. To account for this, ink is configured to be ejected at different timings between the half of the nozzles of the inkjet head on the downstream side in the feeding direction and the half of the nozzles of the inkjet head on the upstream side in the feeding direction. An average value of a gap between a recording medium and the most upstream nozzle in the feeding direction and a gap between the recording medium and the most downstream nozzle in the feeding direction, among the upstream half of the nozzles, is prestored as information of a gap between a recording medium and an upstream half part of the inkjet head in the feeding direction. At the time of printing, an ejection timing (e.g., a delay time) of ink from the upstream half of the nozzles is determined based on the stored gap.

Similarly, an average value of a gap between a recording medium and the most upstream nozzle in the feeding direction and a gap between the recording medium and the most downstream nozzles in the feeding direction, among the downstream half of the nozzles, is prestored as information of a gap between a recording medium and a downstream half part of the inkjet head in the feeding direction. At the time of printing, an ejection timing (e.g., a delay time) of ink from the downstream half of the nozzles is determined based on the stored gap.

SUMMARY

A known so-called serial inkjet printer performs printing on a recording medium while alternately repeating ink ejection from the nozzles in a pass (e.g., a traverse to move the inkjet head in the scanning direction), and feeding of the recording medium in the feeding direction by a predetermined distance.

As described above, a gap between a recording medium and the nozzles is greater as the nozzles are disposed on more downstream side in the feeding direction in the known inkjet printer. Therefore, gaps differ between the recording medium and each nozzle in the upstream half of the nozzles. Therefore, when a timing of ink ejection in a pass from the upstream half of the nozzles is determined based on the average value of gaps between the recording medium and the nozzles in the upstream half of the nozzles as described above, a landing position of ink ejected from the most upstream nozzle in the feeding direction among the upstream half of the nozzles is deviated from a landing position having no deviation (hereinafter, referred to as the ideal landing position). When a timing of ink ejection in a pass from the downstream half of the nozzles is determined based on the average value of gaps between the recording medium and the nozzles in the downstream half of the nozzles as described above, a landing position of ink ejected from the most downstream nozzle in the feeding direction among the downstream half of the nozzles is deviated from the ideal landing position. When an image is printed in a plurality of passes arranged in the feeding direction, ink ejected from the most upstream nozzle, for example, in the first pass among the plurality of passes, and the ink ejected from the most downstream nozzle in the second pass land adjacent to each other in the feeding direction on the recording medium. The landing positions of the most upstream nozzle and the most downstream nozzle are deviated from their respective ideal landing positions. This leads to a deterioration of an image quality at a joint portion of the adjacent images.

Aspects of the disclosure relate to an inkjet printer configured to reduce deviations of landing positions of an image to be printed in each pass at a joint portion with an adjacent image in the feeding direction.

According to an aspect of the present teaching, there is provided an inkjet printer including:

an inkjet head including an ink ejection surface having a nozzle array, the nozzle array having a plurality of nozzles arranged in a first direction, the plurality of nozzles include an upstream nozzle disposed on an upstream side of the nozzle array in the first direction and a downstream nozzle disposed on a downstream side of the nozzle array in the first direction, each nozzle being configured to selectivity eject ink;

a head scanning mechanism configured to position the inkjet head opposite a recording medium, and to move the inkjet head along a second direction parallel to the ink ejection surface and perpendicular to the first direction;

a feeding mechanism configured to feed the recording medium along the first direction;

a storage device configured to store upstream correction information relating to a position of the nozzle array in the second direction and an upstream correction value for ink ejection timing for ejecting ink from the nozzle array, the upstream correction value being based on a gap between an upstream nozzle of the nozzle array and the recording medium in a third direction orthogonal to the first direction and the second direction, and downstream correction information relating to the position of the nozzle array in the second direction and a downstream correction value for the ink ejection timing, the downstream correction value being based on a gap between a downstream nozzle of the nozzle array and the recording medium in the third direction; and a controller configured to:

control the inkjet head, the head scanning mechanism and the feeding mechanism to repeatedly perform a scanning operation by moving the inkjet head along the second direction and a feeding operation by feeding the recording medium along the first direction, and to print an image on the recording medium by ejecting the ink from the nozzle array during the scanning operation; and determine a correction value for a specific scanning operation by using at least one of the upstream correction information and the downstream correction information, wherein the controller is further configured to perform at least one of the following when determining the correction value for a specific scanning operation:

a first determination process for determining the correction value for the specific scanning operation by using the upstream correction information when an image is to be printed on an upstream area adjacent, on an upstream side in the first direction, to a specific area corresponding to the specific scanning operation and when no image is to be printed on a downstream area adjacent, on a downstream side in the first direction, to the specific area; and a second determination process for determining the correction value for the specific scanning operation by using the downstream correction information when no image is to be printed on the upstream area adjacent to the specific area and when an image is to be printed on the downstream area adjacent to the specific area.

According to an aspect of the present teaching, there is provided an inkjet printer including:

an ink jet head having a plurality of nozzles;

a head scanning mechanism configured to move the ink jet head in multiple passes in a scanning direction during an ink jet printing operation;

a feeding mechanism configured to move a print medium in a feeding direction during the ink jet printing operation; and a controller configured to perform the following:

determine whether a specified pass in the ink jet printing operation has an adjacent downstream pass having an image;

determine whether the specified pass has an adjacent upstream pass having an image;

determine whether to use an upstream correction information, a downstream correction information, or both, to calculate an ink jet timing for the specified pass based on the determinations of whether the specified pass has an adjacent downstream pass having an image and whether the specified pass has an adjacent upstream pass having an image;

calculate the ink jet timing based on the upstream correction information, downstream correction information, or both; and conduct the specified pass in the ink jet printing operation using the ink jet timing.

According to an aspect of the present teaching, there is provided a method including:

determining whether a specified pass in an ink jet printing operation has an adjacent downstream pass having an image;

determining whether the specified pass has an adjacent upstream pass having an image;

determining whether to use an upstream correction information, a downstream correction information, or both, to calculate an ink jet timing for the specified pass based on the determinations of whether the specified pass has an adjacent downstream pass having an image and whether the specified pass has an adjacent upstream pass having an image;

calculating the ink jet timing based on the upstream correction information, downstream correction information, or both; and conducting the specified pass in the ink jet printing operation using the ink jet timing.

BRIEF DESCRIPTION OF THE DRAWINGS

FIG. 3A depicts the printing unit when viewed along an arrow IIIA in FIG. 2.

FIG. 3B depicts the printing unit when viewed along an arrow IIIB in FIG. 2.

FIG. 4A is a sectional view taken along a line IVA-IVA in FIG. 2

FIG. 4B is a sectional view taken along a line IVB-IVB in FIG. 2.

FIGS. 16A-16C depicts a relationship of landing positions of ink ejected from the upstream nozzle and the downstream nozzle and when delay times for the downstream nozzles are determined in consideration of amplitudes of gaps and an average gap between the nozzles and a recording sheet and, wherein FIG. 16A depicts the landing positions when a portion of the recording sheet that opposes downstream nozzles is evenly disposed to each side in a scanning direction, 16B depicts the landing positions when a portion of the sheet that opposes the downstream nozzles is shifted to the right side, and FIG. 16C depicts the landing positions when a portion of the recording sheet that opposes the downstream nozzles is shifted to the left side.

DETAILED DESCRIPTION

Hereinafter, example features for one or more illustrative embodiments will be described.

(General Structure of Inkjet Printer)

Figure 1:
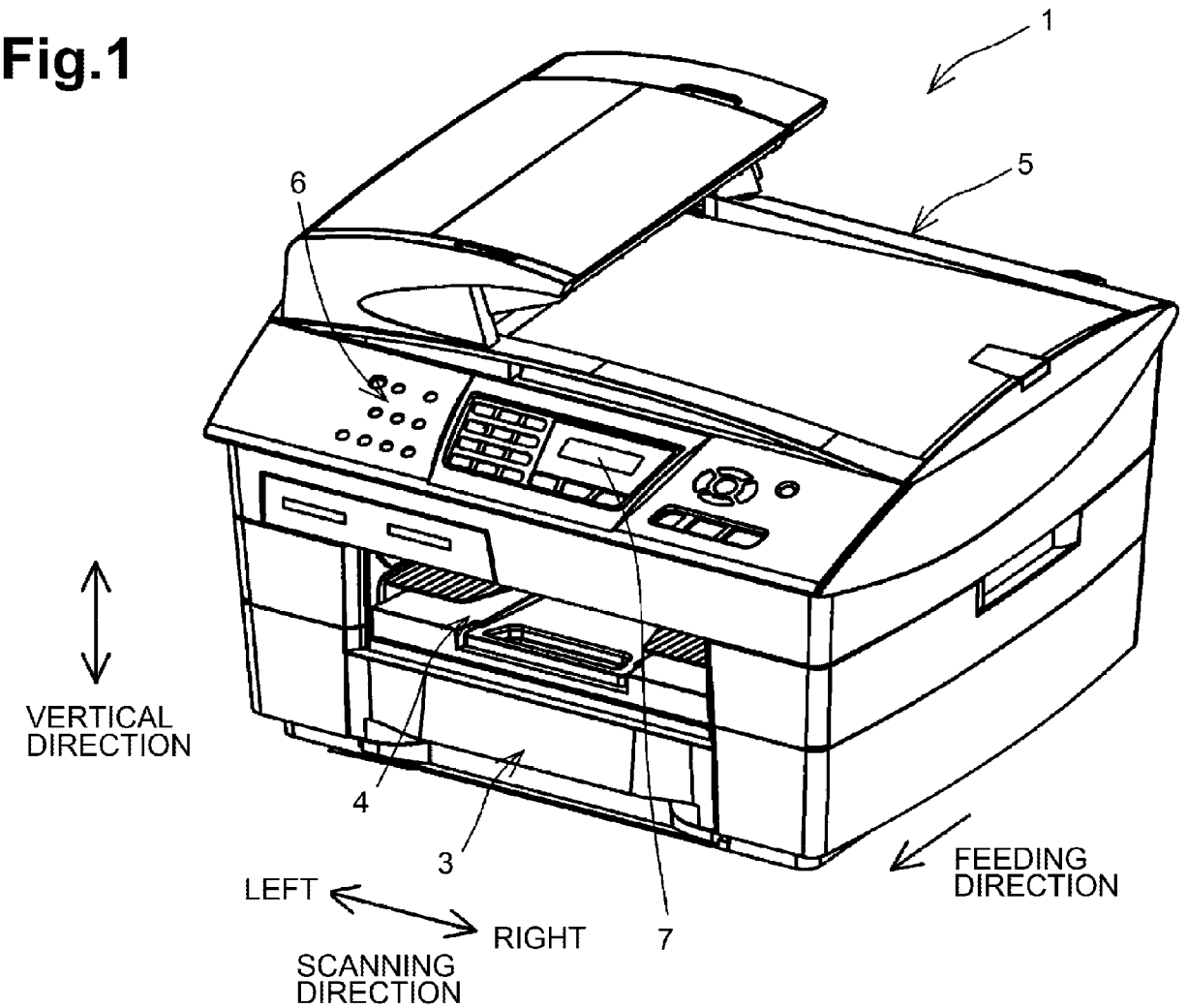
FIG. 1 is a perspective view of an inkjet printer in an illustrative embodiment according to one or more aspects of the disclosure.

An inkjet printer 1 may be a multi-functional device configured to perform image reading, as well as printing onto a recording medium, e.g., a recording sheet P. As depicted in the example of FIG. 1, the inkjet printer 1 may include a printing unit 2 (refer to FIG. 2), a sheet feeding unit 3, a sheet discharging unit 4, a reading unit 5, an operation unit 6, and a display unit 7. A controller 50 (refer to FIG. 5) may be configured to control operations of the inkjet printer 1.

The printing unit 2 may be located in an interior of the inkjet printer 1. The printing unit 2 may be configured to perform printing on the recording sheet P. A detailed configuration of an example embodiment of the printing unit 2 will be described later. The sheet feeding unit 3 may be configured to feed the recording sheet P to be printed by the printing unit 2. The sheet discharging unit 4 may be configured to discharge the recording sheet P printed by the printing unit 2. The reading unit 5 may include a scanner. The reading unit 5 may be configured to read an image, e.g., a deviation detecting pattern (described later). The operation unit 6 may include buttons. A user may be allowed to operate the inkjet printer 1 via the buttons of the operation unit 6. The display unit 7 may include a display, such as a liquid crystal display. The display unit 7 may be configured to display necessary information when the inkjet printer 1 is used.

(Printing Unit)

Figure 2:
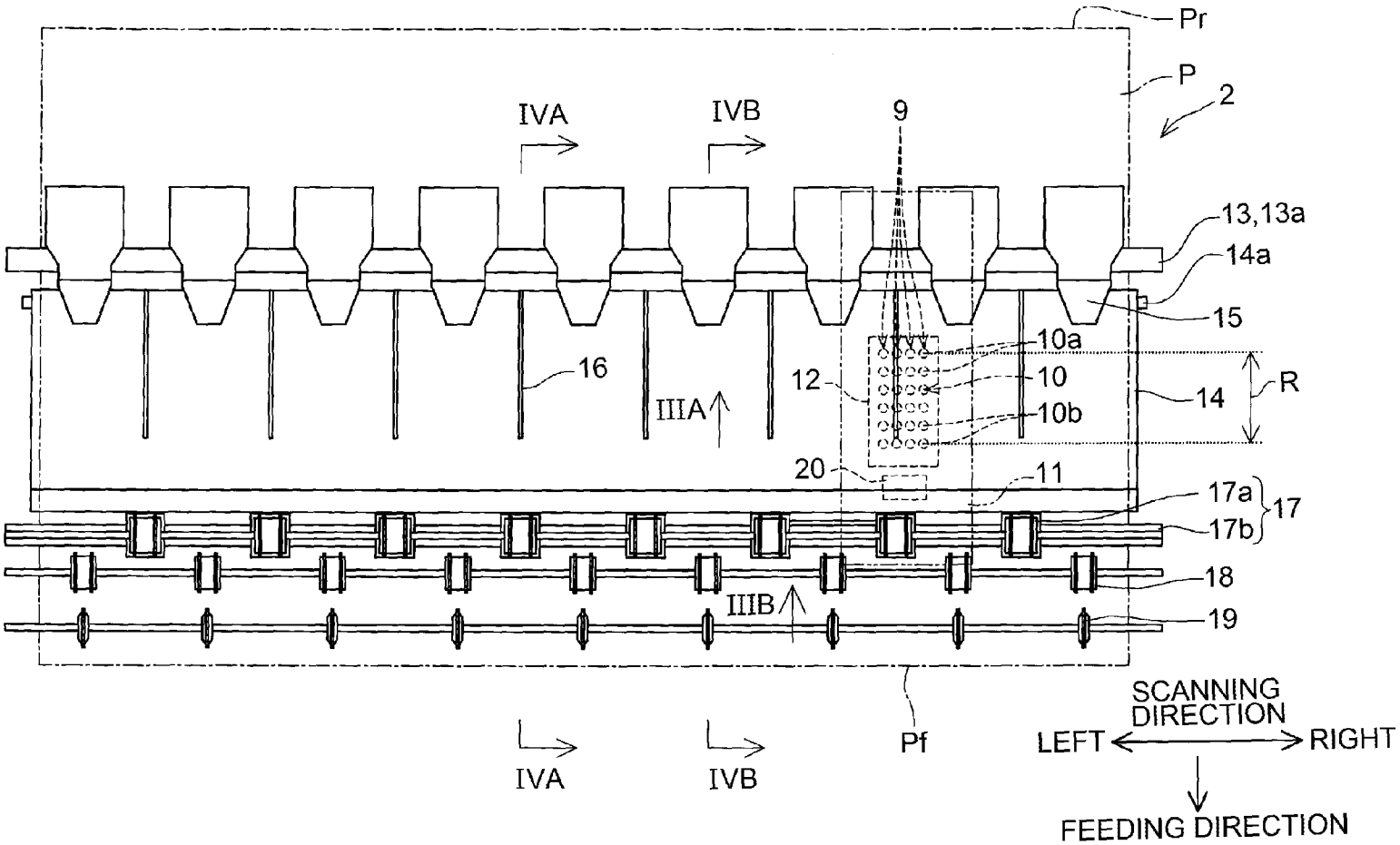
FIG. 2 is a plan view of a printing unit.

Next, an example of the printing unit 2 will be described. As depicted in FIGS. 2-4, the printing unit 2 may include a head scanning mechanism, e.g., a carriage 11, an inkjet head 12, a feed roller 13, a platen 14, upstream wave shape generating members, e.g., a plurality of corrugated plates 15, a plurality of corrugated ribs 16, a discharge roller 17, downstream wave shape generating members, e.g., a plurality of corrugated spurs 18 and 19, and an encoder 20. To facilitate understanding in FIG. 2, the carriage 11 is indicated by two-dot chain lines, and portions disposed below the carriage 11 are indicated by solid lines.

The carriage 11 may be configured to be driven by a carriage motor 29 (refer to FIG. 5) to reciprocate in a second direction, e.g., a scanning direction. Hereinafter, the disclosure will be described in conjunction with the right and left in the scanning direction, as depicted in, for example, FIGS. 1 and 2. The inkjet head 12 may be mounted on the carriage 11, and may be configured to eject ink from a plurality of nozzles 10 formed on an ink ejection surface 12*a* that is a lower surface of the inkjet head 12. A plurality of the nozzles 10 may be arranged in a first direction, e.g., a feeding direction, perpendicular to the scanning direction in a length R, to form nozzle arrays 9. In the illustrated example, four nozzle arrays 9 are aligned along the scanning direction on the ink ejection surface 12*a*. The nozzles 10 constituting each of the nozzle arrays 9 may be configured to eject black, yellow, cyan, and magenta inks in this order from the right nozzle array 9 in the scanning direction. The inkjet head 12 may be configured to eject ink from the nozzles 10 of the same nozzle array 9 at the same timing. The ink ejection surface 12*a* may be parallel to the scanning direction and the feeding direction.

The feed roller 13 may include a pair of rollers. The feed roller 13 may be configured to nip or hold therebetween the recording sheet P fed by the sheet feeding unit 3 and feed the recording sheet P in the feeding direction. In the illustrative embodiment, the downward direction in FIG. 2 may be an example of the feeding direction. The feed roller 13 may be provided with a rotary encoder 27 (refer to FIG. 5) configured to detect a rotation amount of the feed roller 13.

The platen 14 may be disposed to face the ink ejection surface 12*a*. The recording sheet P fed by the feed roller 13 may be fed along an upper surface 14*a* of the platen 14, which may be rotatably supported about a pivot shaft 14*b* disposed at an upstream end of the platen 14 in the feeding direction and extending in the scanning direction. The platen 14 may be urged by a spring (not depicted), so that the platen 14 is placed at a position indicated by the solid lines in FIGS. 4A and 4B when the recording sheet P is not fed.

A plurality of the corrugated plates 15 may be disposed to face an upstream end of the upper surface 14*a* of the platen 14 in the feeding direction. The corrugated plates 15 may be arranged at substantially regular intervals in the scanning direction. The recording sheet P, fed by the feed roller 13, passes between the platen 14 and the corrugated plates 15. The corrugated plates 15 may press the recording sheet P from above with pressing surfaces 15*a*, which may be lower surfaces of the corrugated plates 15. At this time, the platen 14 may be pressed down by the corrugated plates 15 and the recording sheet P. As indicated by a dot-and-dash line in FIGS. 4A and 4B, the platen 14 may pivot about the pivot shaft 14*b* in the clockwise direction. The thicker the recording sheet P, the more the platen 14 pivots. Thus, the upper surface 14*a* of the platen 14 moves further from the ink ejection surface 12*a* as the thickness of the recording sheet P is greater. In some embodiments, a gap between the recording sheet P placed on the upper surface 14*a* of the platen 14 and the ink ejection surface 12*a* may be made constant regardless of the thicknesses of the recording sheets P.

A plurality of the ribs 16 may be disposed on the upper surface 14*a* of the platen 14 between the corrugated plates 15 in the scanning direction. The ribs 16 may be arranged at substantially regular intervals along the scanning direction. Each rib 16 may protrude from the upper surface 14*a* of the platen 14 up to a level higher than the pressing surfaces 15*a* of the corrugated plates 15. Each rib 16 may extend from an upstream end of the platen 14 toward a downstream side in the feeding direction. Thus, the recording sheet P on the platen 14 may be supported from underneath by the ribs 16.

The discharge roller 17 may include a pair of rollers. The discharge roller 17 may be configured to nip or hold therebetween portions of the recording sheet P that are located in the same positions as the plurality of ribs 16 in the scanning direction and feed the recording sheet P toward the sheet discharging unit 4 in the feeding direction. An upper roller 17*a* of the discharge roller 17 may be provided with a spur to prevent or reduce ink attached or landed on the recording sheet P from transferring to the upper roller 17*a*.

Figure 5:
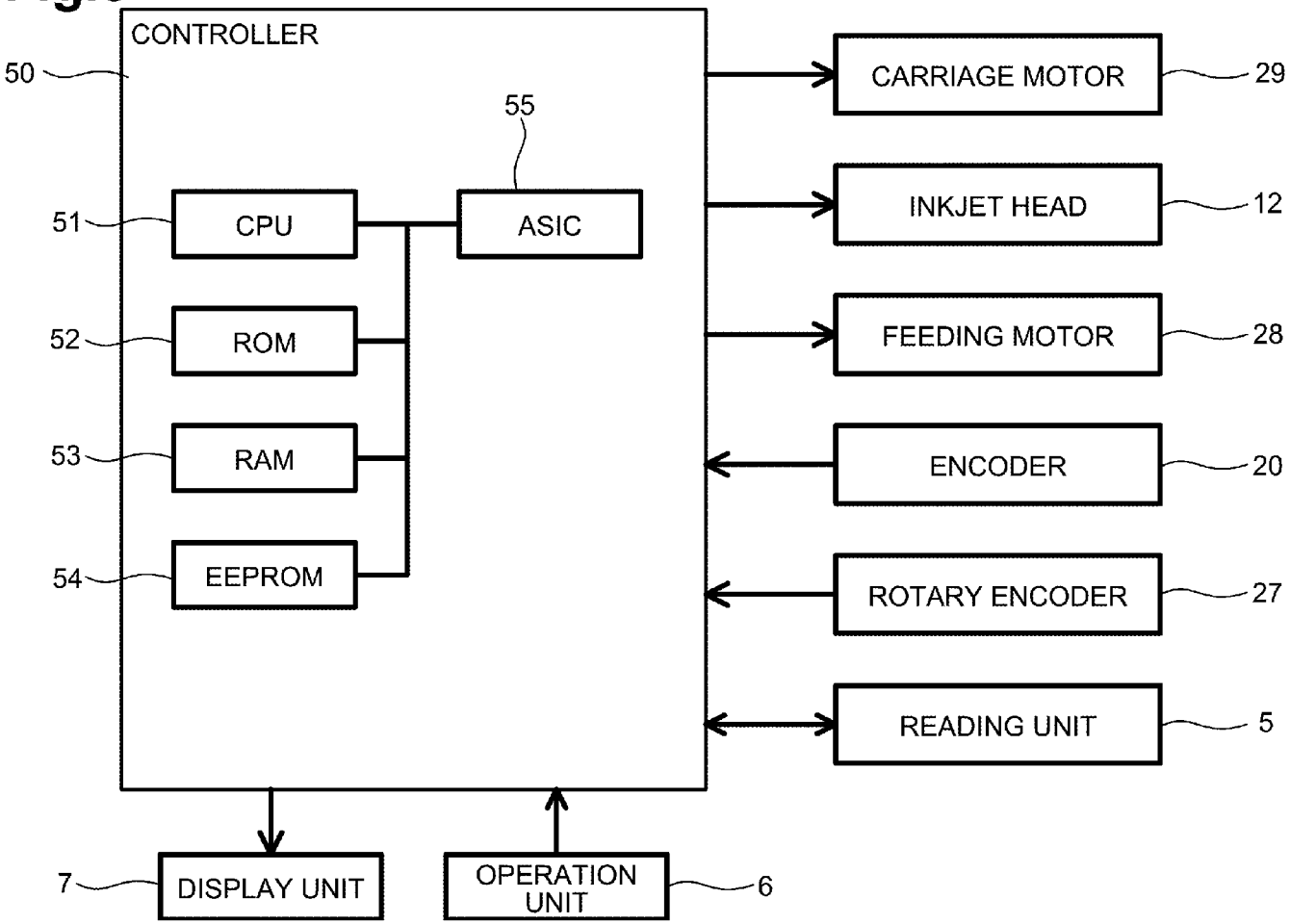
FIG. 5 is a block diagram illustrating hardware configuration of the inkjet printer.
Figure 6:
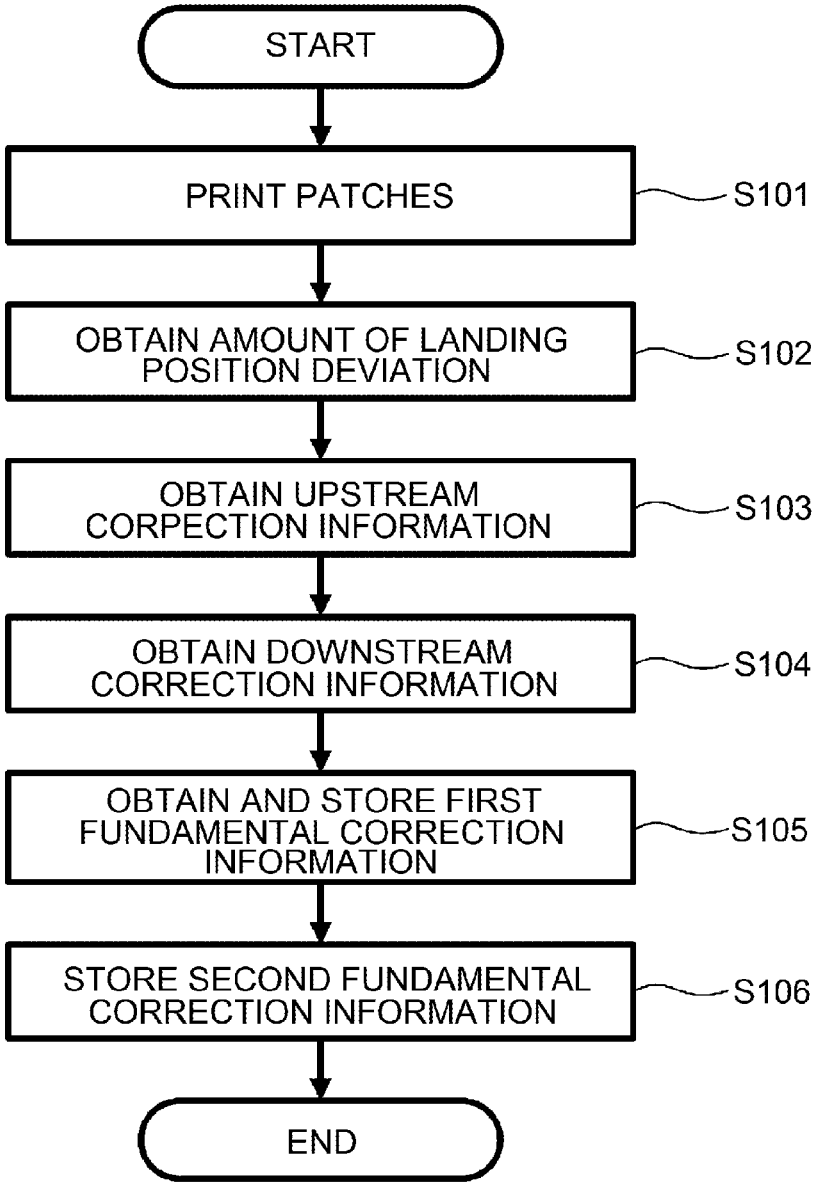
FIG. 6 is a flowchart illustrating processes of obtaining and storing first and second fundamental correction information.

A lower roller 13*b* of the feed roller 13 and a lower roller 17*b* of the discharge roller 17 may be drive rollers driven by a feeding motor 28 (refer to FIG. 5). An upper roller 13*a* of the feed roller 13 and the upper roller 17*a* of the discharge roller 17 may be driven rollers that rotate in association with the rotation of the corresponding drive rollers. In the illustrative embodiment, a combination of the feed roller 13 and the discharge roller 17 may be an example of a feeding mechanism.

A plurality of the corrugated spurs 18 may be disposed downstream of the discharge roller 17 in the feeding direction at substantially the same positions as the corrugated plates 15 in the scanning direction. A plurality of the corrugated spurs 19 may be disposed downstream of the corrugated spurs 18 in the feeding direction at substantially the same positions as the corrugated plates 15 in the scanning direction. The corrugated spurs 18 and 19 may be positioned at a level lower, in a third direction, e.g., a vertical direction, than a position where the discharge roller 17 nips or holds the recording sheet P therebetween. The corrugated spurs 18 and 19 may be configured to press the recording sheet P from above at the level. Lower ends of the corrugated spurs 18 and 19 disposed downstream of the inkjet head 12 in the feeding direction may be disposed slightly higher than the pressing surfaces 15*a* of the corrugated plates 15 disposed upstream of the inkjet head 12 in the feeding direction. Pressing force of the corrugated spurs 18 and 19 against the recording sheet P may be lower than that of the corrugated plates 15. Each of the corrugated spurs 18 and 19 may be a spur, as opposed to a roller having a flat outer circumferential surface. Therefore, the ink attached onto the recording sheet P may be prevented or reduced from transferring to the corrugated spurs 18 and 19.

The recording sheet P supported on the platen 14 by a plurality of the ribs 16 from below may be pressed from above by a plurality of the corrugated plates 15 and a plurality of the corrugated spurs 18 and 19. Therefore, the recording sheet P may be deformed in a wave or corrugated shape, as depicted in FIGS. 3A and 3B, to have ridge portions Pm protruding upward and groove portions Pv depressed downward. The ridge portions Pm and the groove portions Pv may be alternately arranged along the scanning direction. Each ridge portion Pm may have a top portion Pt protruding up to the highest level of the ridge portion Pm. The top portion Pt may be located substantially at the same position as the center of the corresponding rib 16 in the scanning direction. Each groove portions Pv may have a bottom portion Pb depressed down to the lowest level of the groove portions Pv. The bottom portion Pb may be located substantially at the same position as the corresponding corrugated plate 15 and the corresponding corrugated spurs 18 and 19.

The encoder 20 may be mounted on the carriage 11 and configured to detect the position of the carriage 11 in the scanning direction.

The printing unit 2 structured as described above may be configured to perform printing by ejecting ink on the recording sheet P while alternately repeating ink ejection in a pass (e.g., a traverse to move the inkjet head 12 together with the carriage 11 in the scanning direction), and feeding of the recording medium P with the rollers 13 and 17 by a predetermined distance, e.g., the length R of the nozzle array 9, in the feeding direction.

(Controller)

Next, an example of the controller 50 configured to control the operations of the inkjet printer 1 will be described. As depicted in FIG. 5, the controller 50 may include a central processing unit (CPU) 51, a read only memory (ROM) 52, a random access memory (RAM) 53, a storage device, e.g., an electrically erasable programmable read only memory (EEPROM) 54, and an application specific integrated circuit (ASIC) 55. These components 51-55 may be configured to control operations of, for example, the reading unit 5, the carriage motor 29, the inkjet head 12, the feeding motor 28, and the display unit 7, in response to, for example, operations of the operation unit 6. Signals associated with operations of the operation unit 6 and detection signals of the encoder 20 and the rotary encoder 27 may be input to the controller 50.

FIG. 5 depicts a single CPU 51. The controller 50 may include a single CPU 51 and the single CPU 51 may perform all processes. Alternatively, the controller 50 may include a plurality of the CPUs 51 and the CPUs 51 may perform all of the processes in cooperation with each other. FIG. 5 depicts a single ASIC 55. The controller 50 may include a single ASIC 55 and the single ASIC 55 may perform all processes. Alternatively, the controller 50 may include a plurality of the ASICs 55 and the ASICs 55 may perform processes in cooperation with each other. Further, a combination of the CPU 51 and the ASIC 55 may be used to perform the processes.

(Printing by Printing Unit)

Next, a method for printing in the printing unit 2 under the control of the controller 50 will be described. In the illustrative embodiment, for example, after the inkjet printer 1 is just manufactured, first fundamental correction information and second fundamental correction information to determine a correction value, e.g., a delay time, for an ejection timing of ink from the nozzles 10 may be obtained and stored in the EEPROM 54. The first fundamental correction information and the second fundamental correction information will be described later in detail.

The delay time will be described. In the inkjet printer 1, information on the ejection timing of ink in each pass from the nozzles 10 onto a recording sheet P which is not corrugated or wave-shaped, e.g., gap is constant between the ink ejection surface 12*a* and the recording sheet P, is prestored in the EEPROM 54 as information of reference timing. The delay time represents how much time the ejection timing of ink from the nozzles 10 is delayed from the reference timing.

Figure 7A:
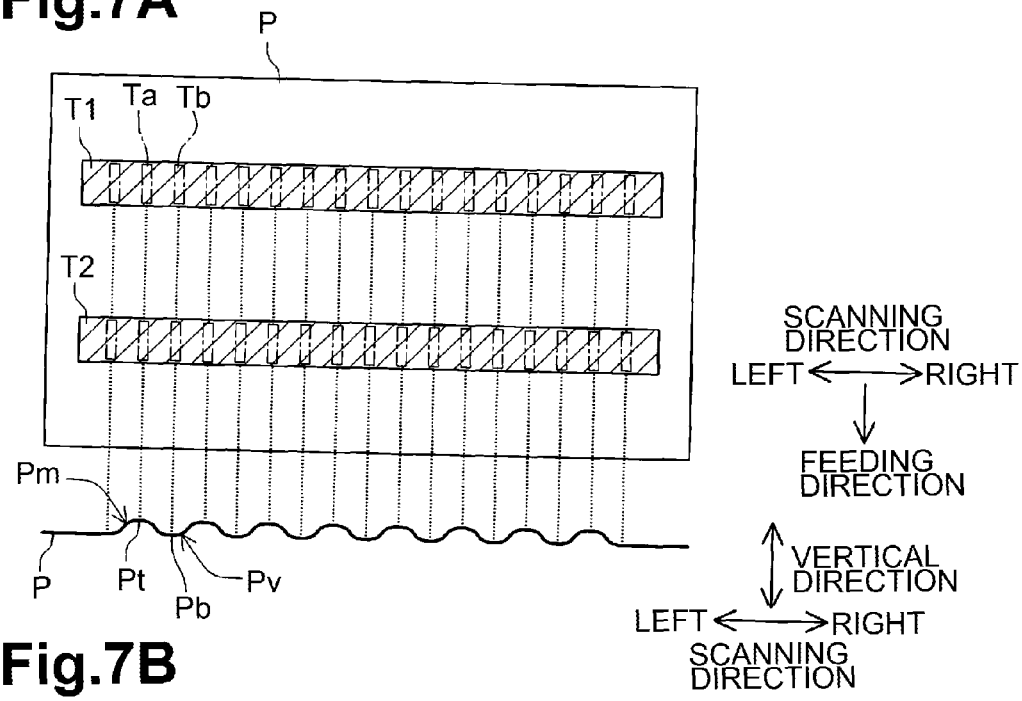
FIG. 7A depicts two patches printed on a recording sheet and reading positions in the patches.

Next, an example method for obtaining the first fundamental correction information and the second fundamental correction information will be described. First, as depicted in FIG. 7A, two patches T1 and T2 including deviation detecting patterns Q may be printed on the recording sheet P, to obtain the first correction information and second correction information (step S101). Hereinafter, for example, "step S101" is simply referred to as "S101" and the word "step" is omitted.

Figure 7B:
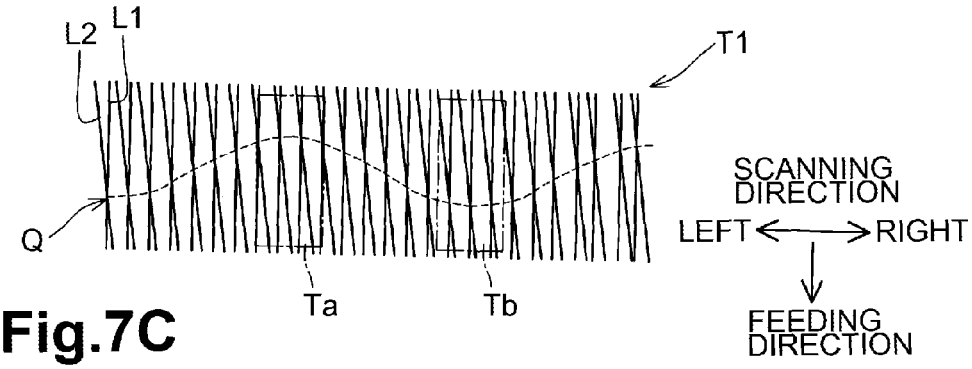
FIG. 7B is a partially enlarged view of a patch printed on an upstream side in a feeding direction of a recording sheet.

To print the patch T1, first, a plurality of straight lines L1, which extend in parallel with the feeding direction and are arranged along the scanning direction, may be printed by ejecting ink from the number "n" of upstream-side nozzles 10 (hereinafter, referred to as the upstream nozzles 10*a*) among a plurality of the nozzles 10 constituting the nozzle array 9, while the carriage 11 is moved rightward in the scanning direction. The number "n" may be smaller than the half number of the nozzles 10 constituting one nozzle array 9. Then, a plurality of the straight lines L2, which are tilted with respect to the feeding direction and intersect the plurality of the respective straight lines L1, may be printed by ejecting ink from the upstream nozzles 10*a* while the carriage 11 is moved leftward in the scanning direction. Thus, the patch T1 may be printed that includes a plurality of the deviation detecting patterns Q arranged along the scanning direction. Each deviation detecting pattern Q may include a combination of the mutually intersecting straight lines L1 and L2, as depicted in FIG. 7B.

Figure 7C:
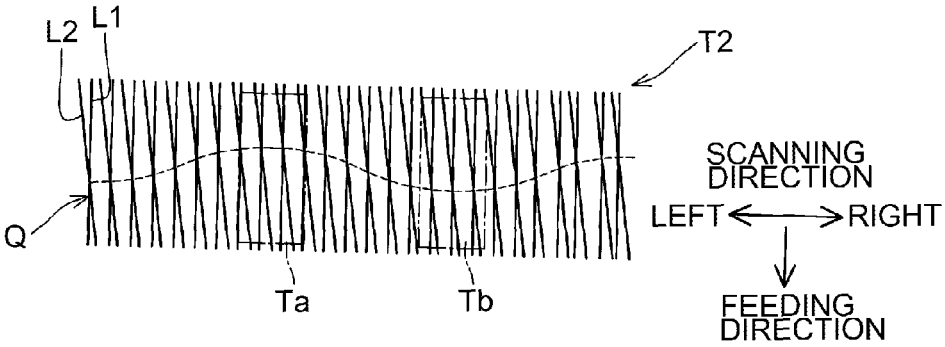
FIG. 7C is a partially enlarged view of a patch printed on a downstream side in the feeding direction.

To print the patch T2, first, a plurality of straight lines L1 similar to those described above may be printed by ejecting ink from the number "n" of downstream-side nozzles 10 (hereinafter, referred to as the downstream nozzles 10*b*) among a plurality of the nozzles 10 constituting the nozzle array 9, while the carriage 11 is moved rightward in the scanning direction. Then, a plurality of the straight lines L2 similar to those described above may be printed by ejecting ink from the downstream nozzles 10*b* while the carriage 11 is moved leftward in the scanning direction. Thus, the patch T2 is printed that includes the plurality of the deviation detecting patterns Q arranged along the scanning direction, as depicted in FIG. 7C.

Figure 8A:
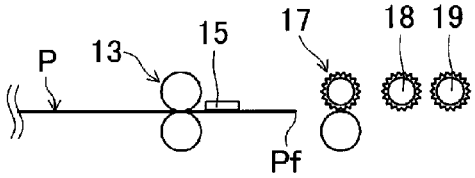
FIG. 8A-D diagrammatically depicts a positional change of a recording sheet in the feeding direction.
Figure 8B:
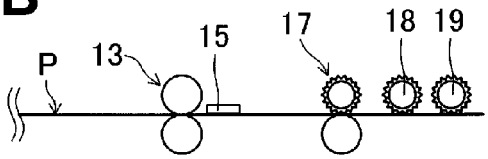
Figure 8C:
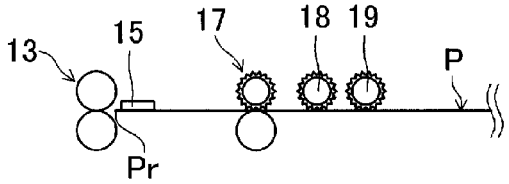
Figure 8D:
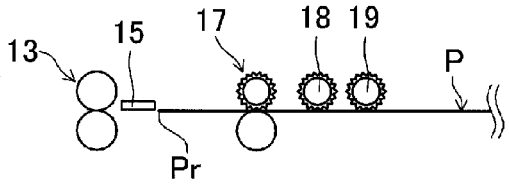
Figure 8D:
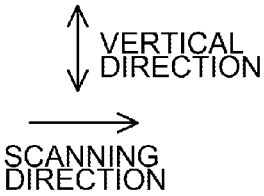

In the printing unit 2, the recording sheet P to be fed by the feed roller 13 and the discharge roller 17 may be pressed by the feed roller 13 and the corrugated plates 15, as depicted in FIG. 8A, until a downstream end of the recording sheet P in the feeding direction (hereinafter, referred to as the leading end Pf) reaches the discharge roller 17 and the corrugated spurs 18 and 19 after the leading end Pf has reached the corrugated plates 15. Thereafter, the recording sheet P may be pressed by the feed roller 13, the corrugated plates 15, the discharge roller 17 and the corrugated spurs 18 and 19, as depicted in FIG. 8B, until an upstream end of the recording sheet P in the feeding direction (hereinafter, referred to as the trailing end Pr) passes the feed roller 13. Thereafter, the recording sheet P may be pressed by the corrugated plates 15, the discharge roller 17 and the corrugated spurs 18 and 19, as depicted in FIG. 8C, until the trailing end Pr of the recording sheet P passes the corrugated plates 15. The trailing end Pr of the recording sheet P may be pressed by the discharge roller 17 and the corrugated spurs 18 and 19, as depicted in FIG. 8D, after the trailing end Pr of the recording sheet P passes the corrugated plates 15. In the illustrative embodiment, the patches T1 and T2 may be printed in a state, for example, as depicted in FIG. 8B.

When the patches T1 and T2 are printed, ink is ejected from the nozzles 10, for example, at the reference timing. If a delay time has been determined in a procedure as described below before the patches T1 and T2 are printed, ink may be ejected at a timing which is delayed from the reference timing by the determined delay time.

Then, the reading unit 5 may read the deviation detecting patterns Q of the printed patches T1 and T2 to obtain information on amounts of landing position deviations with respect to the upstream nozzles 10*a* in each top portion Pt and each bottom portion Pb, from the reading results (S102).

More specifically, when the deviation detecting patterns Q are printed, for example, as depicted in FIGS. 7B and 7C, with landing position deviations in the rightward movement and leftward movement of the carriage 11 in the scanning direction, the printed straight line L1 and the straight line L2 may be oppositely deviated from each other in the scanning direction. Therefore, the straight lines L1 and L2 may form an intersection in a position deviated from the center of the straight lines L1 and L2 in the feeding direction, depending on the amount of the landing position deviation in the scanning direction. When the reading unit 5 reads the deviation detecting patterns Q, the brightness detected at the intersection of the straight lines L1 and L2 is higher than the brightness at other portions. Therefore, the position where the straight lines L1 and L2 intersect may be detected by reading the deviation detecting patterns Q, and obtaining the position with the highest brightness.

In the illustrative embodiment, sections Ta and Tb of the deviation detecting patterns Q that respectively correspond to the top portions Pt and the bottom portions Pb, are read in a plurality of the deviation detecting patterns Q of the patches T1 and T2. The amount of the landing position deviation at each top portion Pt and bottom portion Pb may be obtained by obtaining the position with the highest brightness in the read deviation detecting patterns Q. In S102, the sections Ta and Tb of the deviation detecting patterns Q may be read. Therefore, such deviation detecting patterns Q that forms at least the sections Ta and Tb may be printed in S101 among a plurality of the deviation detecting patterns Q.

The amounts of the landing position deviations at the top portions Pt and the bottom portions Pb may be obtained in S102. In the illustrative embodiment, the recording sheet P may be corrugated along the scanning direction, as described above. Therefore, the amounts of the landing position deviations at other portions may be estimated from the amounts of the landing position deviations at the top portions Pt and the bottom portions Pb. The amount of the landing position deviation is due to a gap between the nozzle 10 and the recording sheet P. Thus, obtaining the amounts of the landing position deviations in each of the top portions Pt and bottom portions Pb in the patches T1 and T2 in S102, is substantially the same as obtaining information on variation of the gaps between the upstream nozzles 10*a*/the downstream nozzles 10*b* and the recording sheet P along the scanning direction.

The reading of the deviation patterns need not be performed by the reading unit 5. In S102, for example, instead of the reading unit 5, a scanner, separate from the inkjet printer 1, may read the deviation detecting patterns Q, and the reading result may be input to the inkjet printer 1.

Next, upstream correction information, e.g., information on delay times for the upstream nozzle 10*a* in each of the top portions Pt and the bottom portions Pb, may be obtained from the information obtained in S102 on the amount of the landing position deviation in each top portion Pt and bottom portion Pb in the patch T1 (S103). Downstream correction information, e.g., information on delay times for the downstream nozzle 10*b* in each of the top portions Pt and the bottom portions Pb, may be obtained from the information on the amount of the landing position deviation in each top portion Pt and bottom portion Pb in the patch T2. (S104). The relationship between the amounts of the landing position deviations (e.g., gaps) and the delay times will be described later.

In S103 and S104, the delay times in the top portions Pt and the bottom portions Pb may be obtained. In the illustrative embodiment, the recording sheet P may be corrugated along the scanning direction, as described above. Therefore, the amounts of the landing position deviations in other portions may be estimated for the delay times in the top portions Pt and the bottom portions Pb. Accordingly, the upstream correction information, e.g., information on the delay times in each of the top portions Pt and the bottom portions Pb, obtained in S103, is substantially the same as information about the relationship between positions of the upstream nozzles 10*a* in the scanning direction and delay times for the upstream nozzles 10*a*. Similarly, the downstream correction information, e.g., information on the delay times in each of the top portion Pt and the bottom portion Pb, obtained in S104, is substantially the same as information about the relationship between positions of the downstream nozzles 10*b* in the scanning direction and delay times for the downstream nozzles 10*b*.

Next, an average value of the delay times obtained in S103 and in S104 in each top portion Pt is calculated as the average delay time in each top portion Pt. An average value of the delay times obtained in S103 and in S104 in each of the bottom portions Pb is calculate as the average delay time in each bottom portion Pb. The information on the obtained average delay times in the top portion Pt and the bottom portion Pb (hereinafter, referred to as the average correction information) is stored in the EEPROM 54 as the first fundamental correction information (S105). The upstream correction information obtained in S103 is stored in the EEPROM 54 as second fundamental correction information (S106).

In S105, the average delay times in the top portion Pt and the bottom portion Pb may be stored. In the illustrative embodiment, the recording sheet P may be corrugated along the scanning direction, as described above. Therefore, the average delay times in other portions between the top portion Pt and the bottom portion Pb may be estimated from the average delay times in the top portion Pt and the bottom portion Pb. Accordingly, the first fundamental correction information stored in the EEPROM 54 in S105 is substantially the same as the information on the relationship between positions of the nozzles 10 in the scanning direction and average delay times. The second fundamental correction information stored in the EEPROM 54 in S106 is the same as the upstream correction information obtained in S103. Therefore, the second fundamental correction information is substantially the same as the information on the relationship between positions of the upstream nozzles 10*a* in the scanning direction and delay times for the upstream nozzles 10*a*, as described above.

Figure 9:
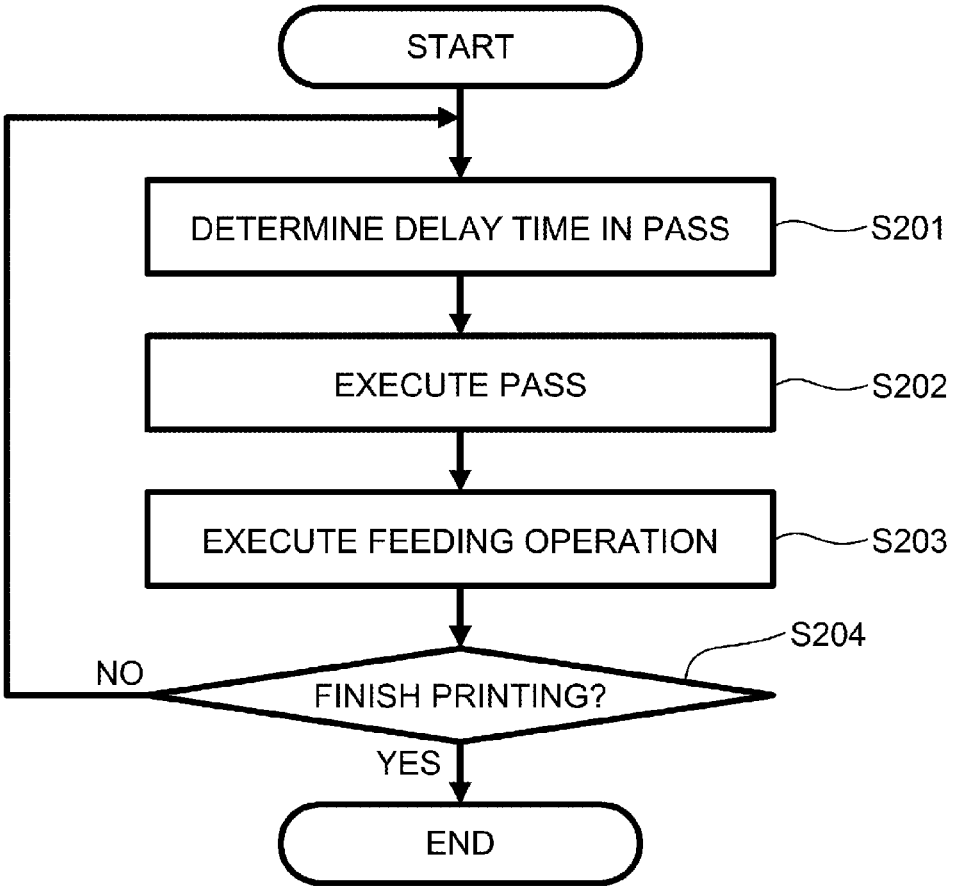
FIG. 9 is a flowchart illustrating processes of printing in the printing unit.
Figure 10:
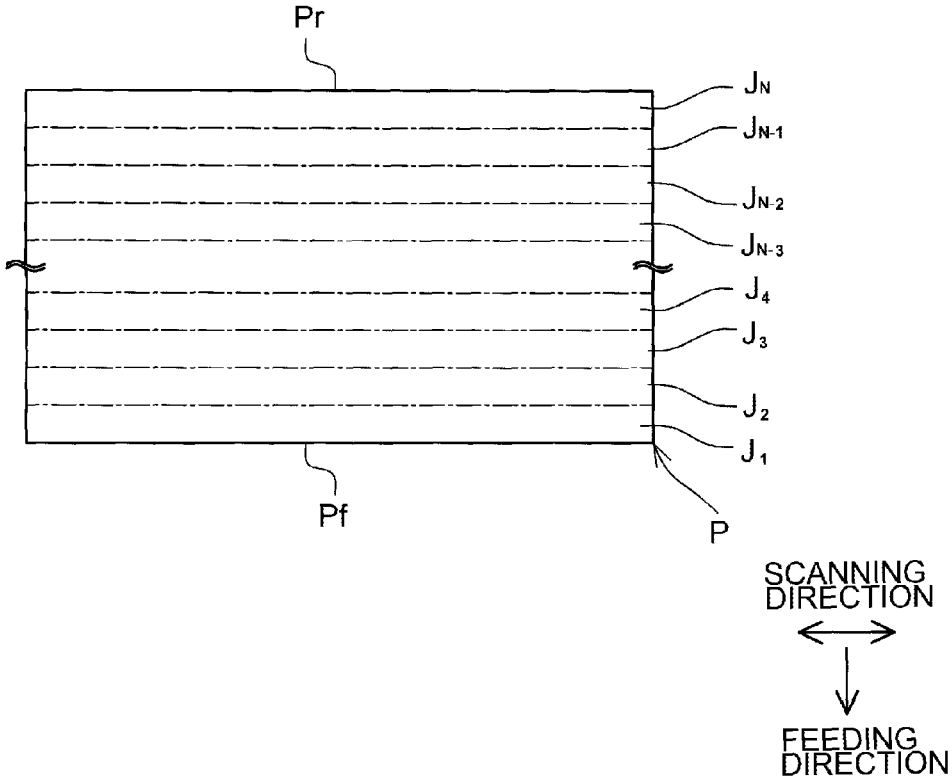
FIG. 10 depicts an area of a recording sheet where an image is to be printed in each pass.

Next, an example method for printing in the printing unit 2 will be described. In the printing unit 2, printing may be performed by repeating scanning operations, e.g., passes and feeding operations, as described above. More specifically, as depicted in FIG. 9, first, delay times in a pass to be executed may be determined (S201). A method for determining the delay times will be described later. Then, the pass is executed (S202). Sequentially, a feeding operation may be executed (S203). In the pass executed in S202, ink may be ejected from the nozzles 10 at timings delayed from the reference timing by the delay times determined in S201. In the feeding operation in S203, the recording sheet P may be fed by the length R, which may be the same length as that of the nozzle array 9 in the feeding direction. At this time, the detection result of the rotary encoder 27 is used to rotate the rollers 13 and 17 by an amount necessary to feed the recording sheet P by the length R. The operations in S201-S203 may be repeated until the printing is finished (S204:NO). When the printing is finished (S204:YES), the printing processes end. For example, when the number "N" of passes is executed to perform printing on a single recording sheet P, the recording sheet P is equally divided into "N" parts in the feeding direction to form an area $J_m$ ($_m$=1, 2, . . . , and N), as depicted in FIG. 10. An image is printed in each pass sequentially from a downstream area $J_m$ in the feeding direction (in the order of $J_1$, $J_2$, . . . , and $J_N$). The area $J_m$ represents an area where an image is to be printed by the m-th pass. The printing unit 2 of the inkjet printer 1 is configured to selectively print in a printing mode, e.g., a photograph printing mode and a draft printing mode, among a plurality of the printing modes. When printing is performed in a printing mode, an image is printed by the number "N" of passes and the recording sheet P is fed by the length R in one feeding operation, as described above.

(Method for Determining Delay Times in Each Pass)

Figure 11:
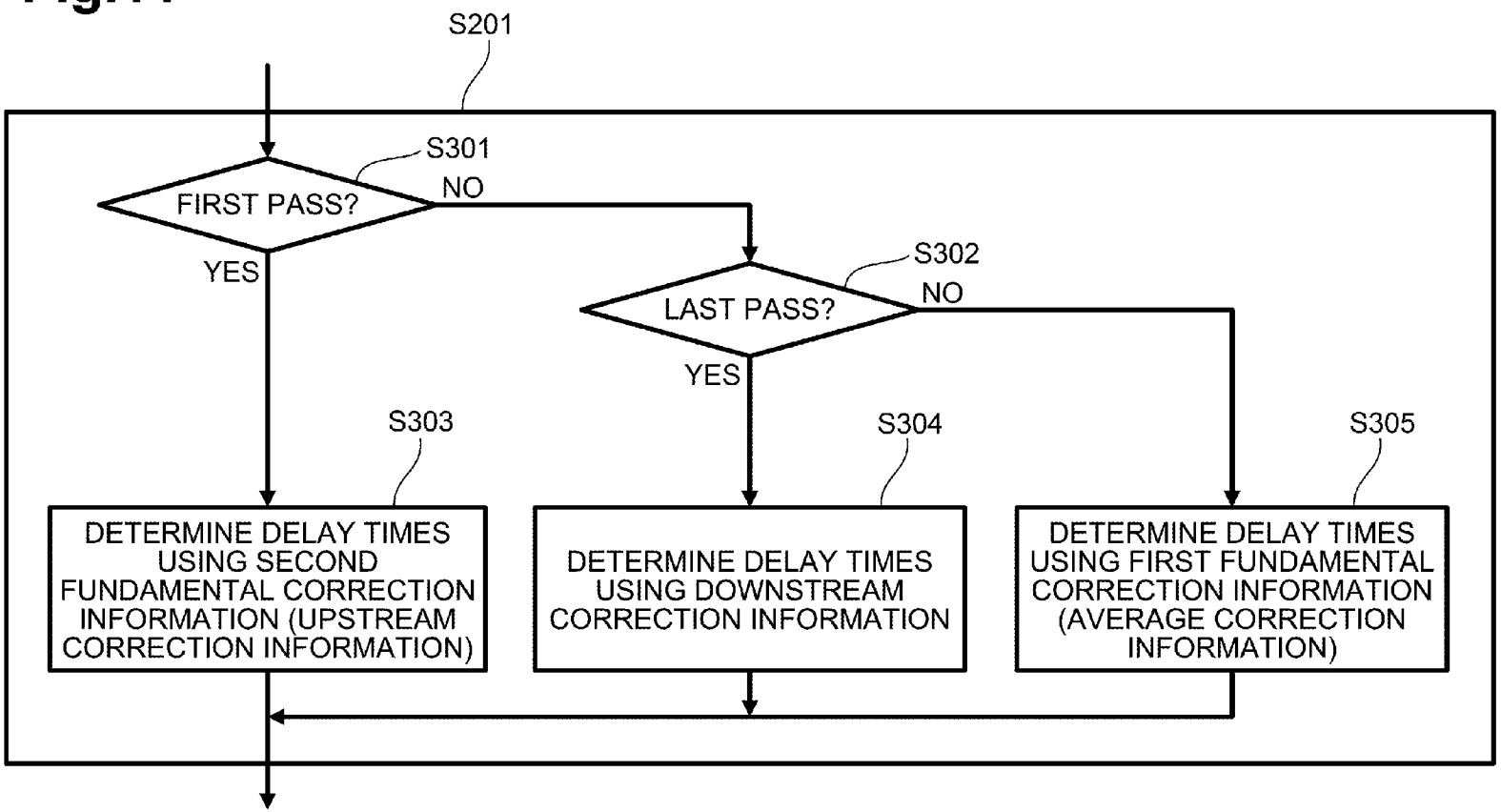
FIG. 11 is a flowchart illustrating details of determining a delay time in FIG. 9.

Next, a method for determining the delay times in S201 will be described in detail. In S201, as depicted in FIG. 11, when a pass to be executed among a plurality of passes for printing on one recording sheet P is the first pass (S301:YES), the delay times in the first pass may be determined (S303, a first determination process, discussed further below) based on the position of the carriage 11 in the scanning direction obtained from the detection result of the encoder 20, and the second fundamental correction information (e.g., the upstream correction information) stored in the EEPROM 54.

When a pass to be executed among a plurality of passes for printing on one recording sheet P is the last pass (S301:NO, S302:YES), the delay times for each of ejection timings in the last pass may be determined (S304, a second determination process, discussed further below) based on the position of the carriage 11 in the scanning direction obtained from the detection result of the encoder 20, and the downstream correction information. At this time, the downstream correction information may be obtained from the first fundamental correction information and the second fundamental correction information stored in the EEPROM 54.

When a pass to be executed among a plurality of passes for printing on one recording sheet P is neither the first pass nor the last pass (S301:NO, S302:NO), the delay times in the pass are determined (S305, a third determination process, discussed further below), based on the position of the carriage 11 in the scanning direction obtained from the detection result of the encoder 20, and the first fundamental correction information (e.g., the average correction information) stored in the EEPROM 54.

In other words, in the illustrative embodiment, the delay times in each pass may be determined using at least one of the fundamental correction information among the first fundamental correction information and the second fundamental correction information as in S303-S305. The delay times in a plurality of the passes for printing on one recording sheet P may be determined by determining the fundamental correction information (e.g., the first fundamental correction information and/or the second fundamental correction information) is to be used, depending on passes, e.g., the first pass, the last pass, or a pass other than the first and last pass, as in S301-S305.

(Deviations of Ink Landing Positions in Each Pass)

Figure 12A:
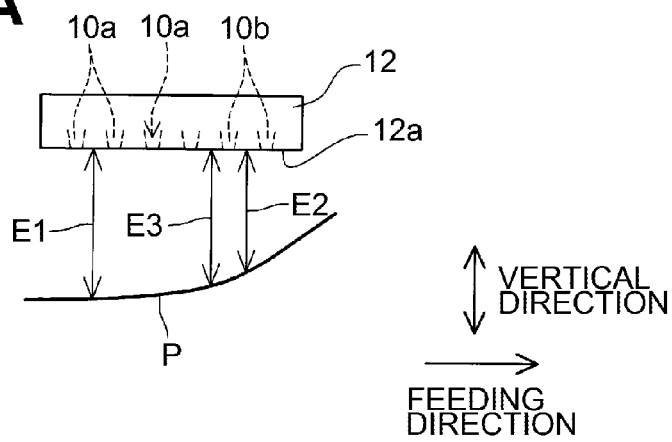
FIG. 12A diagrammatically depicts variations of gaps along the feeding direction between an ink ejection surface and a recording sheet.

As described above, the corrugated plates 15 may be configured to press the recording sheet P with a greater pressing force than the corrugated spurs 18 and 19. As depicted in FIG. 12A, a gap between the ink ejection surface 12*a* and the recording sheet P becomes smaller at a more downstream side in the feeding direction. To facilitate the visual understanding in FIG. 12A, changes in the levels of the recording sheet P along the feeding direction are depicted in an enlarged view, as compared with FIGS. 4A and 4B.

Figures 12B, 12C, 12D:
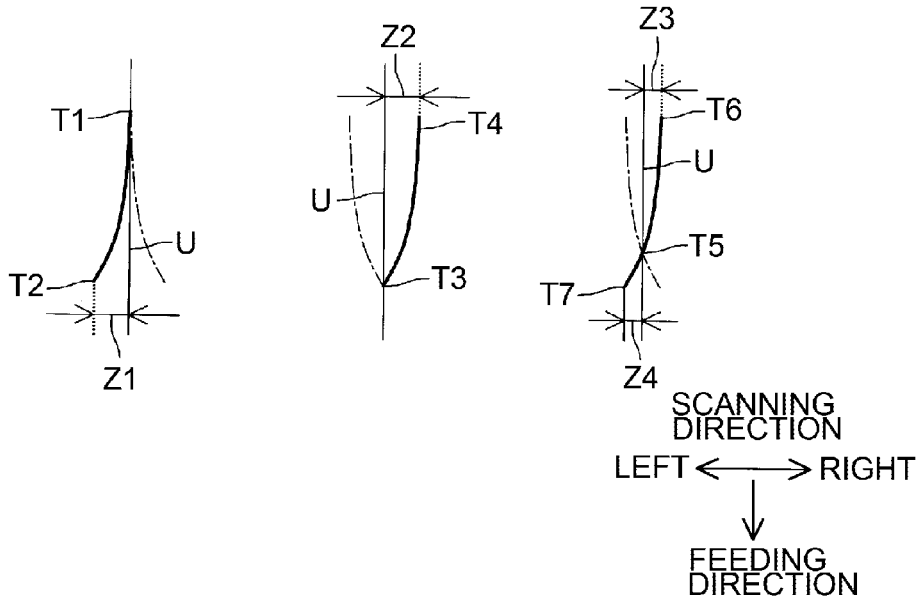
FIG. 12B depicts deviations of landing positions when a delay time is determined using upstream correction information.
FIG. 12C depicts deviations of landing positions when a delay time is determined using downstream correction information.
FIG. 12D depicts deviations of landing positions when a delay time is determined using an average correction information.

In S303, such a delay time may be determined that does not cause the deviation of the ink landing position (e.g., the amount of the landing position deviation is none or zero (0)) when a gap between the upstream nozzle 10*a* disposed at a position in the scanning direction and the recording sheet P is a gap E1 (more precisely, the average value of gaps between the number "n" of the upstream nozzles 10*a* and the recording sheet P). The gap E1 changes as the position of the upstream nozzle 10*a* changes in the scanning direction. In S303, a plurality of delay times may be determined in association with the positions of the upstream nozzle 10*a* in the scanning direction. Therefore, in the pass in which ink is ejected from the nozzles 10 at the timings delayed from the reference timing by the delay times determined in S303, the landing position of ink ejected from the upstream nozzle 10*a*, as depicted in FIG. 12B (e.g., a position T1 in FIG. 12B), may be brought closest to the landing position having no deviations (e.g., a position indicated by a straight line U in FIG. 12B, hereinafter, referred to as the ideal landing position). The landing positions of ink ejected from the nozzles 10 that are positioned more distant from the upstream nozzles 10*a* in the feeding direction may be more deviated with respect to the ideal landing position. The deviation amount of the landing position of ink ejected from the downstream nozzle 10*b* (e.g., a position T2 in FIG. 12B) becomes the greatest with respect to the ideal landing position. Therefore, an ink landing position of an image printed in a pass with the delay times determined based on the upstream correction information is brought closest to the ideal landing position at upstream end in the feeding direction and is most separated from the ideal landing position at the downstream end in the feeding direction.

In FIGS. 12B-12D, the ink landing positions are indicated in a solid line when the carriage 11 is moved rightward in a pass. The ink landing positions are indicated in a dot-and-dash line when the carriage 11 is moved leftward in a pass. The ink landing positions when the carriage 11 is moved rightward and leftward in a pass are symmetrical with each other with respect to the straight line U.

In S304, such a delay time is determined that does not cause the deviation of the ink landing position when a gap between the downstream nozzle 10*b* disposed at a position in the scanning direction and the recording sheet P is a gap E2 (more precisely, the average value of a gap between the number "n" of the downstream nozzles 10*b* and the recording sheet P). The gap E2 changes as the position of the downstream nozzle 10*b* changes in the scanning direction. In S304, a plurality of delay times may be determined in association with the positions of the downstream nozzle 10*b* in the scanning direction. Therefore, in a pass in which ink is ejected from the nozzles 10 at the timings delayed from the reference timing by the delay times determined in S304, the landing position of ink ejected from the downstream nozzle 10*b*, as depicted in FIG. 12C (e.g., a position T3 in FIG. 12C), may be brought closest to the ideal landing position. The landing positions of ink ejected from the nozzles 10 that are positioned on the more upstream side in the feeding direction are more deviated with respect to the ideal landing position. The deviation amount of the landing position of ink ejected from the upstream nozzle 10*a* (e.g., a position T4 in FIG. 12C) becomes the greatest with respect to the ideal landing position. Therefore, an ink landing position of an image printed in a pass with the delay times determined based on the downstream correction information is brought closest to the ideal landing position at downstream end in the feeding direction and is most separated from the ideal landing position at the upstream end in the feeding direction.

In S305, such a delay time may be determined that does not cause the deviation of the ink landing position when a gap between the nozzle 10 disposed at a position in the scanning direction and the recording sheet P is a gap E3 which is the average of the gaps E1 and E2. The gap E3 changes as the position of the nozzle 10 changes in the scanning direction. In S305, a plurality of delay times is determined in association with the positions of the nozzle 10 in the scanning direction. Therefore, in a pass in which ink is ejected from the nozzles 10 at the timings delayed from the reference timing by the delay time determined in S305, the landing positions of ink ejected from the nozzles 10 having a greater difference from the gap E3 with respect to a gap with the recording sheet P, are more deviated with respect to the ideal landing position, as depicted in FIG. 12D. Thus, the landing position of ink ejected from the nozzles 10 having the same gap with the recording sheet P as the gap E3 (e.g., a position T5 in FIG. 12D) is brought closest to the ideal landing position. The landing of ink ejected from the upstream nozzles 10*a* (e.g., a position T6 in FIG. 12D) is most separated from the ideal landing position to one side in the scanning direction (e.g., the left side in FIG. 12D). The landing position of ink ejected from the downstream nozzle 10*b* (e.g., a position T7 in FIG. 12D) is most separated from the ideal landing position to the other side in the scanning direction (e.g., the right side in FIG. 12D).

In this case, a deviation amount Z3 of the landing position of ink ejected from the upstream nozzle 10*a* with respect to the ideal landing position and a deviation amount Z4 of the landing position of ink ejected from the downstream nozzle 10*b* with respect to the ideal landing position are approximately the same (or equal). The deviation amounts Z3 and Z4 are smaller than a deviation amounts Z1 of the landing position of ink ejected from the downstream nozzle 10*b* in FIG. 12B with respect to the ideal landing position and a deviation amounts Z2 of the landing position of ink ejected from the upstream nozzle 10*a* in FIG. 12C with respect to the ideal landing position. Therefore, the ink landing position of an image printed in a pass with the delay times determined based on the average correction information is separated equally at an upstream end and downstream end in the feeding direction with respect to the ideal landing position. In this case, the deviation amount of the ink landing position at each upstream end and downstream end in the feeding direction may be minimized with respect to the ideal landing position.

As depicted in FIG. 10, with respect to the area $J_1$ where an image may be printed on the recording sheet P in the first pass, an image may be printed at the area $J_2$ (where an image may be printed in the second pass) adjacent to the area $J_1$ on the upstream side in the feeding direction. No image is to be printed at an area adjacent to the area $J_1$ on the downstream side in the feeding direction. Therefore, it is preferable that an ink landing position of an image to be printed in the first pass be brought closer to the ideal landing position at a joint portion with an adjacent image on the upstream side in the feeding direction (e.g., the upstream end). In the illustrative embodiment, the delay times may be determined for the first pass using the upstream correction information as in S303. Thus, the deviation amount of the ink landing position of the image to be printed in the first pass may be reduced with respect to the ideal landing position at the joint portion with an image to be adjacently printed in the area $J_2$ on the upstream side in the feeding direction. In this case, the deviation amount of the ink landing position at the downstream end of an image to be printed in the first pass in the feeding direction becomes greater with respect to the ideal landing position. However, no image is to be printed at an area downstream of the area $J_1$ in the feeding direction, where an image is to be printed on the recording sheet P in the first pass. Therefore, such deviation of the landing position may provide reduced influence to the quality of a whole image to be printed.

As depicted in FIG. 10, with respect to an area $J_N$ where an image may be printed on the recording sheet P in the last pass, an image may be printed at the area $J_{N-1}$ (where an image may be printed in the second to the last ([N−1]-th) pass) adjacent to the area $J_N$ on the downstream side in the feeding direction. No image is to be printed at an area adjacent to the area $J_N$ on the upstream side in the feeding direction. Therefore, it is preferable that an ink landing position of an image to be printed in the last pass be brought closer to the ideal landing position at a joint portion with an adjacent image on the downstream side in the feeding direction (e.g., the downstream end). In the illustrative embodiment, the delay times are determined for the last pass using the downstream correction information as in S304. Thus, the deviation amount of the ink landing position of the image to be printed in the last pass may be reduced with respect to the ideal landing position at the joint portion with an image to be adjacently printed in the area $J_{N-1}$ on the downstream side in the feeding direction. In this case, the deviation amount of the ink landing position at the upstream end of an image to be printed in the last pass in the feeding direction becomes greater with respect to the ideal landing position. However, no image is to be printed at an area upstream of the area $J_N$ in the feeding direction, where an image may be printed on the recording sheet P in the last pass. Therefore, such deviation may provide reduced influence to the quality of a whole image to be printed.

As depicted in FIG. 10, with respect to an area $J_m$ (where $_m$=2, 3, . . . , and [N−2]) where an image may be printed on the recording sheet P in a pass other than the first and the last passes (e.g., an area $J_2$ to $J_{N-2}$ where an image may be printed in the second to the [N−2]-th pass), an image may be printed adjacently at areas $J_{m+1}$ and $J_{m-1}$ on the upstream and downstream sides in the feeding direction, respectively. Therefore, it is preferable that ink landing positions of an image to be printed in a pass other than the first and last passes be brought closer to the ideal landing positions as much as possible at joint portions with adjacent images on the downstream and upstream sides in the feeding direction. In the illustrative embodiment, the delay times may be determined for passes other than the first and the last passes using the average correction information as in S305. Thus, the deviation amounts of the ink landing positions of the image to be printed in the pass may be equalized and be reduced as much as possible with respect to the ideal landing positions at the joint portions with the images to be adjacently printed in the areas $J_{m+1}$ and $J_{m-1}$ on the upstream and downstream sides in the feeding direction, respectively. Thus, degradation in the quality of an image to be printed may be minimized.

Figure 13A:
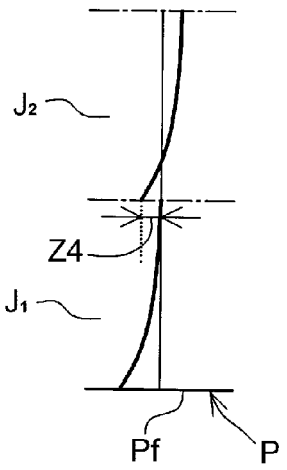
FIG. 13A depicts a deviation amount at a joint portion between an image to be printed in a first pass and an image to be printed in a second pass in the illustrative embodiment.
Figure 13B:
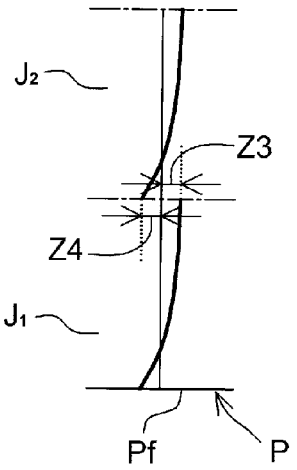
FIG. 13B depicts a deviation amount at the joint portion between the image to be printed in the first pass and the image to be printed in the second pass when a delay time is determined for the first pass using the average correction information.

As printing is performed using the delay times determined as described above, the deviation amount at the joint portion between an image to be printed in the area $J_1$ and an image to be printed in the area $J_2$ becomes Z4, as depicted in FIG. 13A, if the delay times are determined using the upstream correction information and the deviation amount of the landing position of ink ejected from the upstream nozzle 10*a* is zero (0). If the delay times for the first pass are determined using the average correction information and printing is performed, the deviation amount at the joint portion between an image to be printed in the area $J_1$ and an image to be printed in the area $J_2$ may be Z3+Z4, as depicted in FIG. 13B. Accordingly, as the delay times for the first pass are determined using the upstream correction information, the deviation amount at the joint portion between an image to be printed in the area $J_1$ and an image to be printed in the area $J_2$ may be more reduced as compared with a case in which the delay times are determined for the first pass using the average correction information.

Figure 13C:
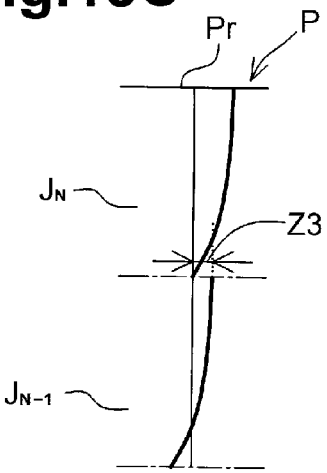
FIG. 13C depicts a deviation amount at a joint portion between an image to be printed in a last pass and an image to be printed in a second to the last pass in the illustrative embodiment.
Figure 13D:
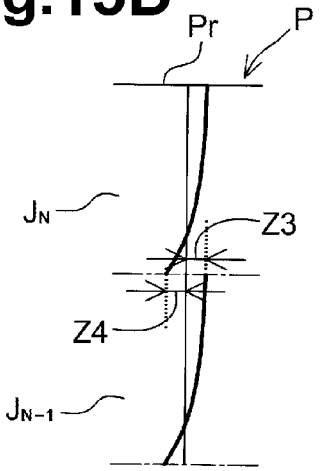
FIG. 13D depicts a deviation amount at the joint portion between an image to be printed in the last pass and an image to be printed in the second to the last pass when a delay time is determined for the last pass using the average correction information.
Figure 13D:
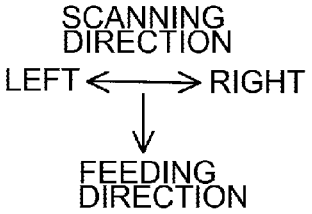
Figure 14A:
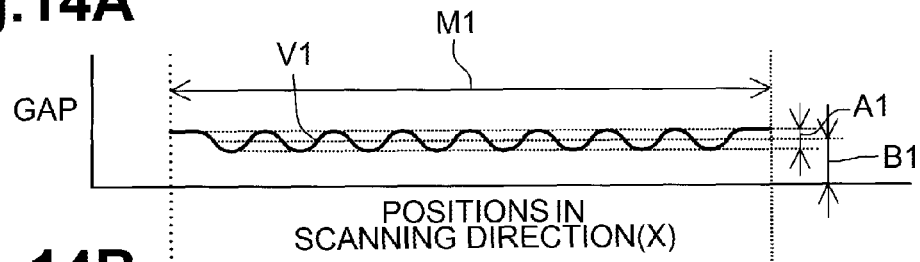
FIG. 14A depicts an example of a relationship between positions of the upstream nozzles in a scanning direction and gaps between upstream nozzles and a recording sheet on a gap plane.

As printing is performed using the delay times determined as described above, the deviation amount at the joint portion of an image to be printed in the area $J_{N-1}$ and an image to be printed in the area $J_N$ becomes Z3, as depicted in FIG. 13C, if the delay times are determined using the downstream correction information and the deviation amount of the landing position of ink ejected from the downstream nozzle 10*b* is zero (0). If the delay times for the last pass are determined using the average correction information and printing is performed, the deviation amount at the joint portion between an image to be printed in the area $J_{N-1}$ and an image to be printed in the area $J_N$ may be Z3+Z4, as depicted in FIG. 14D. Accordingly, as the delay times for the last pass are determined using the downstream correction information, the deviation amount at the joint portion between an image to be printed in the area $J_{N-1}$ and an image to be printed in the area $J_N$ may be more reduced as compared with a case in which the delay times are determined for the last pass using the average correction information.

Accordingly, the quality of a whole image to be printed may improve.

(Relationship Between Gaps and Delay Times)

Next, the relationship between gaps and delay times will be described. On a plane whose horizontal axis represents positions of the nozzles 10 (e.g., the upstream nozzles 10*a*, or the downstream nozzles 10*b*) in the scanning direction and whose vertical axis represents gaps (hereinafter, referred to as the gap plane), a wave shape V1 representing the relationship between positions of the upstream nozzles 10*a* in the scanning direction and gaps between the upstream nozzles 10*a* and the recording sheet P may be drawn. The wave shape V1 has, for example, amplitude A1 and an average gap B1, as depicted in FIG. 14A. Therefore, when printing is performed by ejecting ink from the nozzles 10 at the reference timing, variances in the distance between the ink landing positions in the scanning direction are caused, resulting in the degradation in the image quality.

Figure 15A:
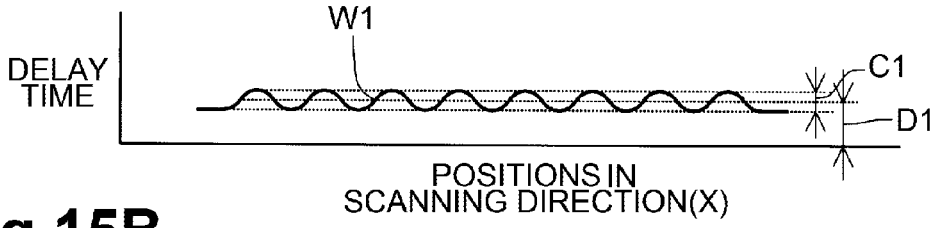
FIG. 15A depicts an example of a relationship between positions of the upstream nozzles in the scanning direction and delay times for the upstream nozzles on a delay plane.

For such case, on a plane whose horizontal axis represents positions of the nozzles 10 (e.g., the upstream nozzles 10*a*, or the downstream nozzles 10*b*) in the scanning direction and whose vertical axis represents delay times (hereinafter, referred to as the delay plane), a wave shape W1 representing the relationship between positions of the upstream nozzles 10*a* in the scanning direction and delay times for the upstream nozzles 10*a* is drawn. The wave shape W1 has, for example, amplitude C1 and an average delay time D1, as depicted in FIG. 15A. The delay times for the upstream nozzles 10*a* may be determined such that the phase of the wave shape W1 is inverted relative to the wave shape V1. Thus, the distance between the ink landing positions in the scanning direction may become constant.

A wave shape V2 representing the relationship between positions of the downstream nozzles 10*b* in the scanning direction and gaps between the downstream nozzles 10*b* and the recording sheet P, may be drawn on the gap plane. As described above, the pressing force of the corrugated spurs 18 and 19 against the recording sheet P may be smaller than that of the corrugated plates 15. Therefore, the wave shape V2 has, for example, an amplitude A2(<A1), and an average gap B2(<B1), as depicted in FIG. 14B.

Figure 15B:
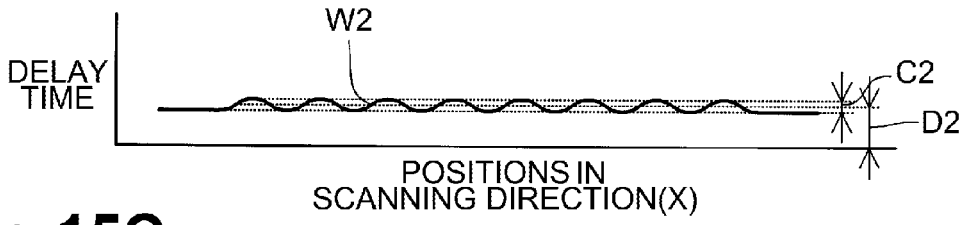
FIGS. 15B-E depict examples of a relationship between positions of the downstream nozzles in the scanning direction and delay times for the downstream nozzles on the delay plane.

In this case, it may be considered that the delay times for the downstream nozzles 10*b* are determined in view of the ratio of the amplitudes A1 and A2 and the difference between the average gaps B1 and B2. For this case, a wave shape W2 representing the relationship between positions of the downstream nozzles 10*b* in the scanning direction and delay times for the downstream nozzles 10*b* may be drawn on the delay plane. The wave shape W2 has, for example, an amplitude C2(<C1), an average delay time D2(>D1), and the inverted phase relative to the wave shape V2, as depicted in FIG. 15B. As the delay times for the downstream nozzles 10*b* are thus determined, the distance between the ink landing positions of ink ejected from the downstream nozzles 10*b* in the scanning direction may become constant.

In this case, the delay times for the upstream nozzles 10*a* and the downstream nozzles 10*b* may be expressed as a function of a position "x" in the scanning direction, e.g., $g_1(x)$ and $g_2(x)$, respectively as follows: "$g_2(x)=a\cdot g_1(x)+b$", where "a" and "b" are constants. The value of the constant "a" may be determined by the ratio between the amplitudes A1 and A2. The value of the constant b may be determined by the difference between the average gaps B1 and B2.

Figure 14B:
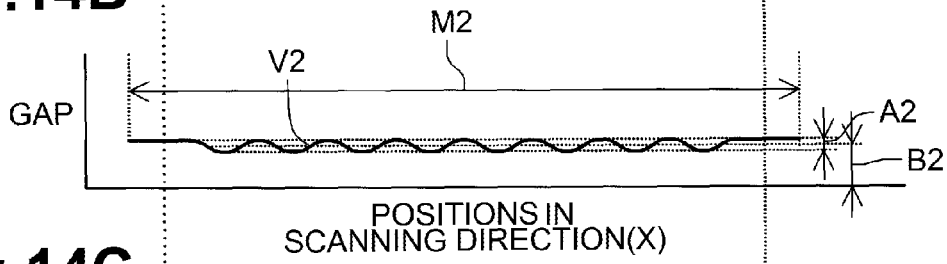
FIGS. 14B-E depict examples of a relationship between positions of the downstream nozzles in the scanning direction and gaps between downstream nozzles and a recording sheet on the gap plane.
Figure 14C:
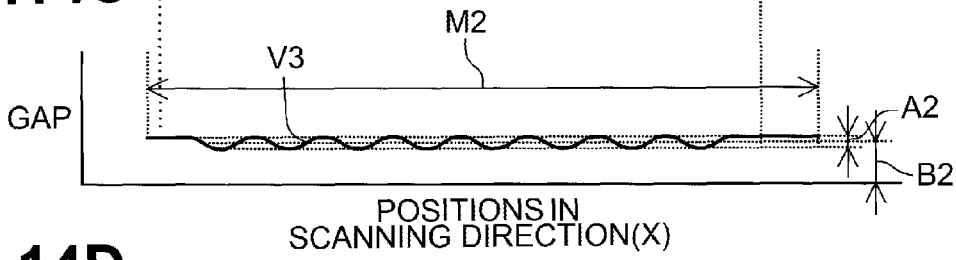
Figure 14D:
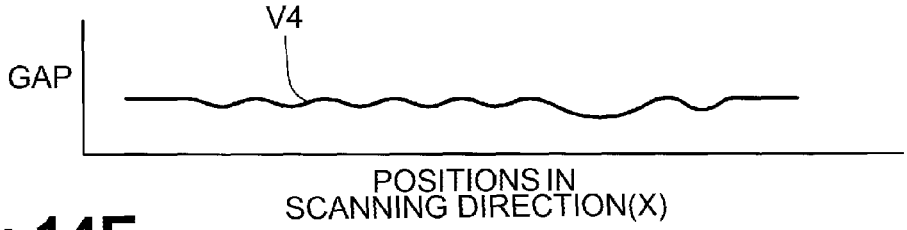

In this case, as can be seen from FIG. 14A and FIG. 14B, the amplitude A2 is smaller than the amplitude A1, so that a portion of the corrugated recording sheet P that opposes the downstream nozzles 10*b* more extends in the scanning direction relative to a portion that opposes the upstream nozzles 10*a*. A length M2 of the portion that opposes the downstream nozzles 10*b* and includes right and left ends of the recording sheet P in the scanning direction may be longer than a length M1 of the portion that opposes the upstream nozzles 10*a* and includes the right and left ends of the recording sheet P in the scanning direction. In FIG. 14B, the left end of the portion of the recording sheet P that opposes the downstream nozzles 10*b* is positioned outside in the scanning direction by a distance of (M1−M2)/2 from the left end of the portion of the recording sheet P that opposes the upstream nozzles 10*a*. The right end of the portion of the recording sheet P that opposes the downstream nozzles 10*b* is positioned outside in the scanning direction by a distance of (M1−M2)/2 from the right end of the portion of the recording sheet P that opposes the upstream nozzles 10*a*. On the contrary, for example, as depicted in FIG. 14C, a distance in the scanning direction between the left end of the portion of the recording sheet P that opposes the downstream nozzles 10*b* and the left end of the portion of the recording sheet P that opposes the upstream nozzles 10*a* may be shorter than a distance in the scanning direction between the right end of the portion that opposes the downstream nozzles 10*b* and the right end of the portion of the recording sheet P that opposes the upstream nozzles 10*a*.

Figure 16A:
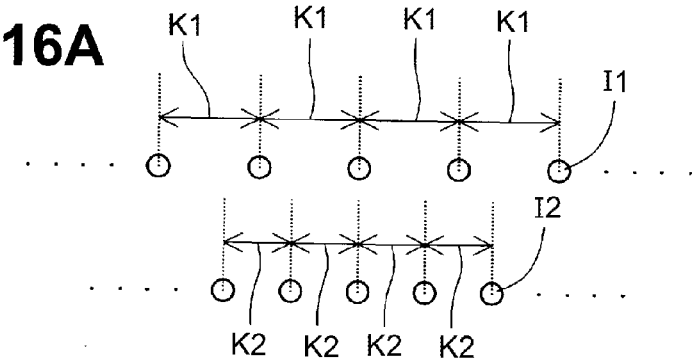
Figure 16B:
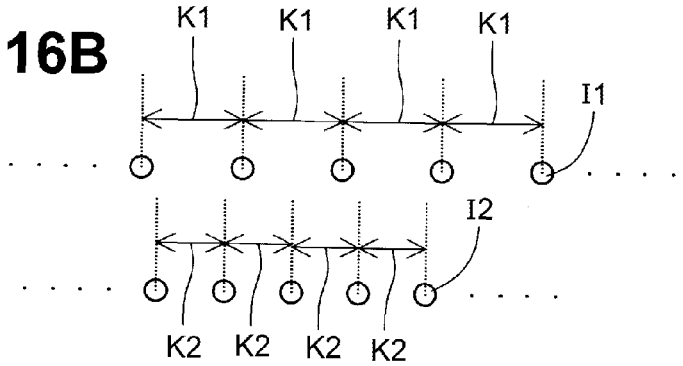
Figure 16C:
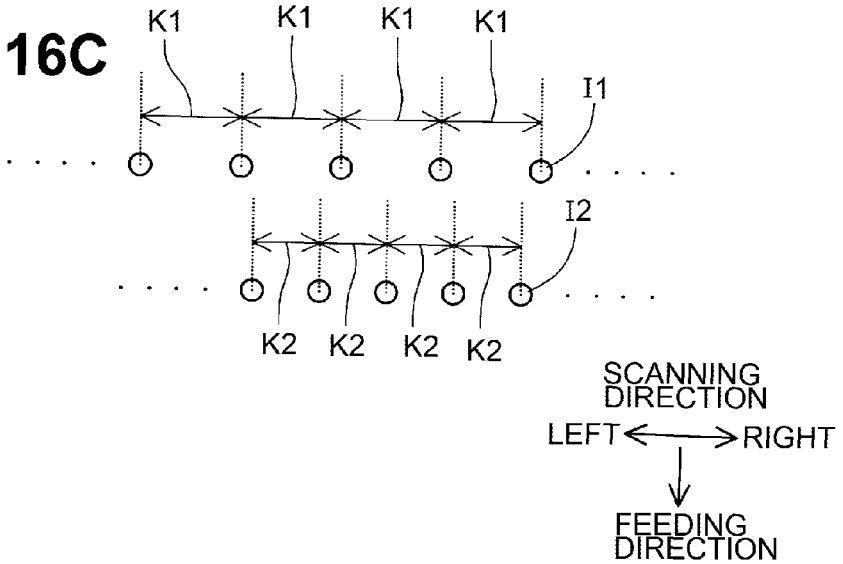

Therefore, as described above, when the delay times for the downstream nozzles 10*b* are determined to satisfy "$g_2(x)=a\cdot g_1(x)+b$", each of distances K1, as depicted in FIGS. 16A-16C, between the landing positions of ink I1 ejected from the upstream nozzle 10*a* and each of distances K2 between the landing positions of ink I2 ejected from the downstream nozzle 10*b* becomes equi-distant but the distance K2 is shorter than the distance K1. At this time, when the left and right ends of the portion that opposes the downstream nozzles 10*b* are positioned away from the left and right ends of the portion that opposes the upstream nozzles 10*b*, respectively, by the same distance in the scanning direction, the ink I2 ejected from the downstream nozzle 10*b* may land at positions, for example, as depicted in FIG. 16A. When the distance in the scanning direction between the left end of the portion that opposes the downstream nozzles 10*b* and the left end of the portion that opposes the upstream nozzles 10*a* is longer than the distance between the right end of the portion that opposes the downstream nozzles 10*b* and the right end of the portion that opposes the upstream nozzles 10*a*, the ink I2 ejected from the downstream nozzle 10*b* may land at positions shifted to the left from the landing positions depicted in FIG. 16A, as depicted in FIG. 16B. When the distance in the scanning direction between the left end of the portion that opposes the downstream nozzles 10*b* and the left end of the portion that opposes the upstream nozzles 10*a* is shorter than the distance in the scanning direction between the right end of the portion that opposes the downstream nozzles 10*b* and the right end of the portion that opposes the upstream nozzles 10*a*, the ink I2 ejected from the downstream nozzle 10*b* may land at positions shifted to the right from the landing positions depicted in FIG. 16A, as depicted in FIG. 16C.

Figure 15C:
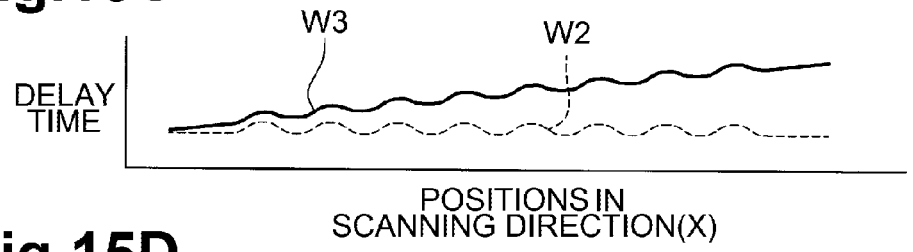

In such case, the delay times for the downstream nozzles 10*b* may be determined by adding such time that increases in proportion to the value of "x", to the delay times represented by the wave shape W2. In this case, when the wave shape W3 representing the relationship between positions of the downstream nozzles 10*b* in the scanning direction and delay times for the downstream nozzles 10*b* may be drawn on the delay plane, the wave shape W3 may be as depicted in, for example, FIG. 15C. In this case, the function, "$g_2(x)=a\cdot g_1(x)+c\cdot x+b$" may be satisfied, where "c" is a constant. The value of the constant "c" is determined by the ratio of the lengths M1 and M2. As the value of "c" becomes greater, the distance K2 becomes longer. The ratio of the lengths M1 and M2 is determined by the ratio of the amplitudes A1 and A2, and the number of the ridge portions Pm and the groove portions Pv. The value of the constant "b" may be determined by a difference between the average gaps B1 and B2 and how much the portion of the recording sheet P that opposes the downstream nozzles 10*b* extends or is shifted to which side in the scanning direction with respect to the portion of the recording sheet P that opposes the upstream nozzles 10*a*. As the value of "b" is greater, the landing position of the ink I2 is shifted more greatly in the scanning direction while the distance K2 is maintained. When the delay times for the downstream nozzles 10*b* are thus determined, the distance K2 is brought closer to the distance K1 and the landing positions of the ink I2 in the scanning direction may be brought closer to the landing positions of the ink I1.

The average delay time may be expressed as a function of "x", e.g., $f_1(x)$, and the delay time for the upstream nozzles 10*a* may be expressed as a function of "x", e.g., $f_2(x)$, as follows: "$f_1(x)=[g_1(x)+g_2(x)]/2$, $f_2(x)=g_1(x)$".

The formula, "$f_2(x)=(2-a)f_1(x)-b$" or "$f_2(x)=(2-a)f_1(x)-c\cdot x-b$" holds when "$g_2(x)=a\cdot g_1(x)+b$" or "$g_2(x)=a\cdot g_1(x)+c\cdot x+b$ is satisfied, where "(2−a)", "−c", and "−b" are constants. When "(2−a)" is expressed as "a", "−c" is expressed as "c", and "−b" is expressed as "b", "$f_2(x)=a\cdot f_1(x)+b$" or "$f_2(x)=a\cdot f_1(x)+c\cdot x+b$" holds.

In a case where "$g_2(x)=a\cdot g_1(x)+b$" or "$g_2(x)=a\cdot g_1(x)+c\cdot x+b$" is satisfied, a wave shape drawn on the delay plane and representing the relationship between positions of the downstream nozzles 10*b* in the scanning direction and delay times for downstream nozzles 10*b* becomes such a wave shape in which a wave shape representing the relationship between positions of the upstream nozzles 10*a* in the scanning direction and delay times for the upstream nozzles 10*a* is expanded, contracted, or parallel-moved. Herein, "an expansion and contraction of a wave shape" includes deformation of the wave shape W1 like the wave shape W2, as well as, for example, deformation of the wave shape W1 like the wave shape W3.

In such case, from any one piece of the upstream correction information, the downstream correction information and the average correction information, the other two pieces of information may be obtained. In other words, in such case, one piece of information among the three pieces of information may be stored in the EEPROM 54. The other two pieces of information among the three pieces of the information are not necessarily stored in the EEPROM 54.

However, the relationship between gaps between the downstream nozzles 10*b* and the recording sheet P and between the upstream nozzles 10*a* and the recording sheet P does not always become the relationship as described above. For example, the pressing force of the corrugated spurs 18 and 19 against the recording sheet P may be smaller than that the corrugated plates 15. Therefore, either the ridge portions Pm or the groove portions Pv that are supposed to be formed in the recording sheet P may disappear in a portion of the recording sheet P that opposes the downstream nozzles 10*b*. When a wave shape V4 representing the relationship between positions of the downstream nozzles 10*b* in the scanning direction and gaps between the downstream nozzles 10*b* and the recording sheet P is drawn on the gap plane, the wave shape V4 may become, for example, as depicted in FIG. 14D.

Figure 15D:
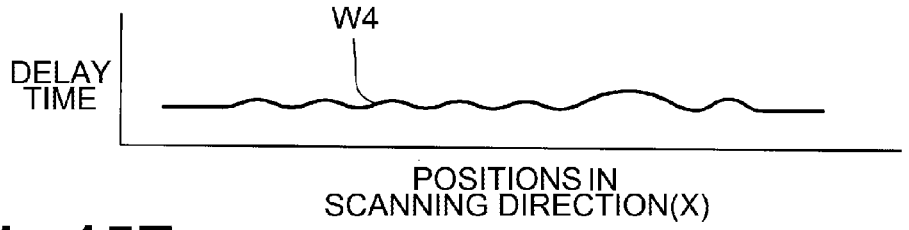

In this case, when the delay times are determined, for such gaps as represented by the wave shape V4, such that distance between the ink landing positions in the scanning direction become constant, in view of for example, the amplitude and the average gap, a wave shape W4 representing the relationship between positions of the downstream nozzles 10*b* in the scanning direction and delay times may be drawn on the delay plane. The wave shape W4 may be, for example, as depicted in FIG. 15D, in which the number of the relative maximum values and the number of the relative minimum values are different from those of the wave shape W1. In this case, "$g_2(x) \neq a \cdot g_1(x)+b$" or "$g_2(x) \neq a \cdot g_1(x)+c \cdot x+b$". Therefore, "$f_2(x) \neq a \cdot f_1(x)+b$" or "$f_2(x) \neq a \cdot f_1(x)+c \cdot x+b$". The wave shape W4 is not what the wave shape W1 is expanded, contracted, or moved parallel.

Figure 14E:
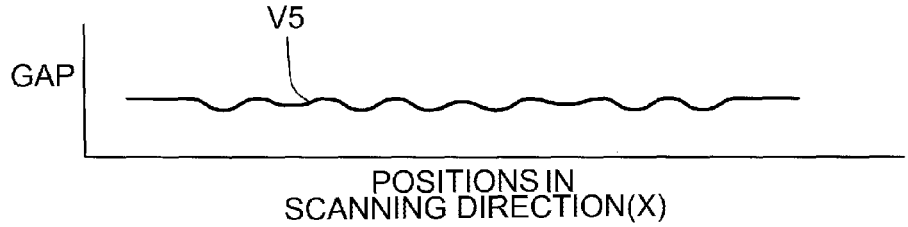

When a wave shape V5 representing the relationship between positions of the downstream nozzles 10*b* in the scanning direction and gaps between the downstream nozzles 10*b* and the recording sheet P is drawn on the gap plane, the wave shape V5 may be, as depicted in FIG. 14E, in which the amplitudes may be greatly varied relative to the wave shape V1 due to variances in pressing forces of the recording sheet P between a plurality of the corrugated spurs 18 and between a plurality of the corrugated spurs 19.

Figure 15E:
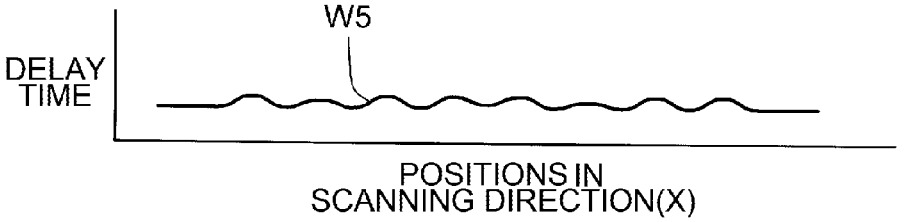

In this case, when the delay times are determined for such gap represented by the wave shape V5, such that the distance between the ink landing positions in the scanning direction becomes constant, for example, in consideration of the amplitude and the average gap, and the wave shape W5 representing the relationship positions of the downstream nozzles 10*b* in the scanning direction and delay times drawn on the delay plane, the wave shape W5 may be as depicted in FIG. 15E, in which the number of the relative maximum and minimum values is same as that of the wave shape W1, but variance in the amplitude is different from that of the wave shape W1. In this case also, "$g_2(x) \neq a \cdot g_1(x)+b$" or "$g_2(x) \neq a \cdot g_1(x)+c \cdot x+b$". Therefore, "$f_2(x) \neq a \cdot f_1(x)+b$" or "$f_2(x) \neq a \cdot f_1(x)+c \cdot x+b$". The wave shape W5 is not what the wave shape W1 is expanded, contracted, or moved parallel.

Therefore, in such case, from one piece of information among the upstream correction information, the downstream correction information and the average correction information, other two pieces of information might not be obtained.

It may differ according the inkjet printers 1 whether the relationship between gaps between the upstream nozzles 10*a* and the recording sheet P and gaps between the downstream nozzles 10*b* and the recording sheet P becomes like the relationship between the wave shape V1 and the wave shape V2 or V3 or between the wave shape V1 and the wave shape V4 or V5, due to dimension errors or deviations of the corrugated plates 15 and the corrugated spurs 18 and 19, and deviations in the assembly of the corrugated plates 15 and the corrugated spurs 18 and 19 into the inkjet printers 1.

In the illustrative embodiment, the first fundamental correction information (e.g., the average correction information) and the second fundamental correction information (e.g., the upstream correction information) may be prestored in the EEPROM 54, as described above. Therefore, the upstream correction information, the downstream correction information and the average correction information may be obtained from the first and second fundamental correction information stored in the EEPROM 54, regardless of the relationship between gaps between the upstream nozzles 10*a* and the recording sheet P, and gaps between the downstream nozzles 10*b* and the recording sheet P. Thus, the delay times determined as in S301-S305 may be appropriate in accordance with gaps between the ink ejection surface 12*a* and the recording sheet P, regardless of whether "$f_2(x)=a \cdot f_1(x)+b$" or "$f_2(x)=a \cdot f_1(x)+c \cdot x+b$" is satisfied.

Next, modifications of the illustrative embodiment will be described.

In the above-described illustrative embodiment, the delay times in the first pass may be determined using the second fundamental correction information (e.g., the upstream correction information). The delay times in the last pass may be determined using the downstream correction information. However, the disclosure is not limited thereto. For example, the delay times for one of the first pass and the last pass may be determined using the first fundamental correction information (e.g., the average correction information).

In the above-described illustrative embodiment, the delay times for all the passes other than the first pass and the last pass may be determined using the first fundamental correction information (e.g., the average correction information). However, the disclosure is not limited thereto.

In the above-described illustrative embodiment, as to the passes other than the second and the second to the last passes among the passes other than the first and the last passes, the delay times may be determined using the average correction information for both immediately preceding pass and immediately following pass. As to the second pass, in the immediately preceding pass (e.g., the first pass), the delay times may be determined using the upstream correction information. In the immediately following pass (e.g., the third pass), the delay times may be determined using the average correction information. As to the second to the last pass, in the immediately preceding pass (the third to the last pass), the delay times may be determined using the average correction information. In the immediately following pass (e.g., the last pass), the delay times may be determined using the downstream correction information. In another embodiment, for example, as to the second pass, the delay times may be determined using the average correction information and the upstream correction information. As to the second to the last pass, the delay times may be determined using the average correction information and the downstream correction information.

Figure 17A:
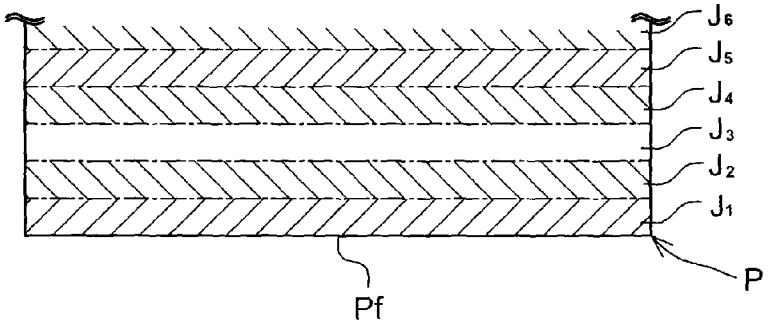
FIG. 17A depicts an area of a recording sheet where an image is to be printed, according to a modification of the illustrative embodiment.

In the above-described illustrative embodiment, the delay times for the first pass may be determined using the upstream correction information. However, the disclosure is not limited thereto. For example, in an area of the recording sheet P where an image is to be recorded by a pass other than the first and the last passes, when an image is printed in an area adjacent to the upstream side and an image is not printed in an area adjacent to the downstream side, the delay times in the pass may be determined using the upstream correction information. More specifically, for example, as depicted in FIG. 17A, as to an area $J_4$ where an image is to be printed by the fourth pass, when an image is printed in an area $J_5$ (where an image is to be printed by the fifth pass) adjacent to the area $J_4$ on the upstream side in the feeding direction, and an image is not printed in an area $J_3$ (where an image is to be printed in the third pass) adjacent to the area $J_4$ on the downstream side in the feeding direction, the delay times for the fourth pass may be determined using the second fundamental correction information (e.g., the upstream correction information). An area $J_m$ where an image is to be printed is hatched in FIG. 17A.

Figure 17B:
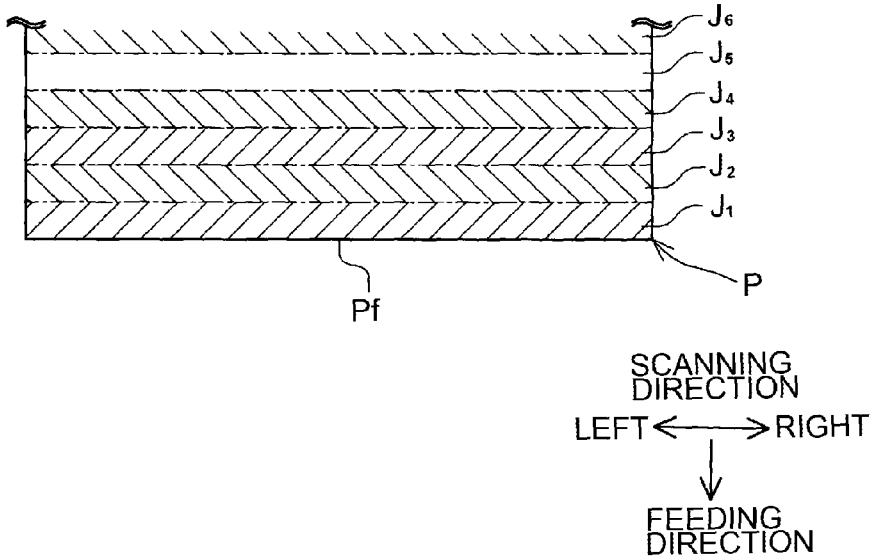
FIG. 17B depicts an area of a recording sheet where an image is to be printed, according to another modification of the illustrative embodiment.

In the above-described illustrative embodiment, the delay times for the last pass may be determined using the downstream correction information. However, the disclosure is not limited thereto. For example, in an area of the recording sheet P where an image is recorded by a pass other than the first and the last passes, when an image is printed in an area adjacent to the downstream side and an image is not printed in an area adjacent to the upstream side, the delay times for the pass may be determined using the downstream correction information. More specifically, for example, as depicted in FIG. 17B, as to the area $J_4$ where an image is to be printed by the fourth pass, when an image is printed in the area J3 (where an image is to be printed by the third pass) adjacent to the area $J_4$ on the downstream side in the feeding direction, and an image is not printed in the area $J_5$ (where an image is to be printed in the fifth pass) adjacent to the area $J_4$ on the upstream side in the feeding direction, the delay time for the fourth pass may be determined using the downstream correction information. An area $J_m$ where an image is to be printed is hatched in FIG. 17B.

In the above-described illustrative embodiment, information on the deviation amounts of the landing positions of the number "n" of the upstream-side nozzles 10 among a plurality of the nozzles 10 constituting the nozzle array 9 in the top portion Pt and the bottom portion Pb and information on the deviation amounts of the landing positions of the number "n" of the downstream-side nozzles 10 among a plurality of the nozzles 10 constituting the nozzle array 9 in the top portion Pt and the bottom portion Pb are obtained. Based on these pieces of the information, the delay times in the top portions Pt and the bottom portions Pb may be determined. However, the disclosure is not limited thereto.

For example, if gaps between a plurality of the nozzles 10 constituting the nozzle array 9 and the recording sheet P are able to be individually obtained, information on a gap between the recording sheet P and one upstream-side nozzle 10 (e.g., the most-upstream nozzle or the second upstream nozzle), among a plurality of the nozzles 10 constituting the nozzle array 9 in the feeding direction in the ridge portion Pm and the groove portion Pv, and information on a gap between the recording sheet P and one downstream-side nozzle 10 (e.g., the most-downstream nozzle or the second downstream nozzle) in the feeding direction in the ridge portion Pm and the groove portion Pv may be obtained. Based on these pieces of the information, the delay times in the top portions Pt and the bottom portions Pb may be determined.

The first fundamental correction information and the second fundamental correction information are not limited to those described above in the illustrative embodiment. For example, the first fundamental correction information and the second fundamental correction information may be two pieces of information, among the upstream correction information, the downstream correction information and the average correction information, different from those described in the illustrative embodiment.

Further, the disclosure is not limited to storing the first and second fundamental correction information, each representing the relationship between positions of the nozzles 10 in the scanning direction and delay times. For example, when "$f_2(x)=a\cdot f_1(x)+c\cdot x+b$" is always satisfied regardless of the inkjet printers 1, the first fundamental correction information similar to that described above in illustrative embodiment may be stored in the EEPROM 54. Instead of the second fundamental correction information, information about the values of the constants "a", "b" and "c" may be stored. In this case also, the upstream correction information and the downstream correction information may be obtained from the information stored in the EEPROM 54.

In the above-described illustrative embodiment, ink ejection timings from the nozzles 10 may be corrected by delaying ink ejection timings from the nozzles 10 relative to the reference timing. However, the disclosure is not limited thereto. Ink ejection timings from the nozzles 10 may be corrected by advancing ink ejection timings from the nozzles 10 relative to the reference timing, if possible.

In the above-described illustrative embodiment, the recording sheet P may be corrugated along the scanning direction by pressing the recording sheet P with the corrugated plates 15 and the corrugated spurs 18 and 19. However, the disclosure is not limited thereto. The recording sheet P may be corrugated along the scanning direction in a different manner. For example, a suction opening for suctioning a recording sheet P may be provided at a portion of the platen 14 between the adjacent ribs 16 in the scanning direction. The recording sheet P may suctioned at the suction opening, to corrugate the recording sheet P along the scanning direction.

Further, what causes variations or changes in gaps between the ink ejection surface 12*a* and the recording sheet P along the scanning direction is not limited to corrugations of the recording sheet P along the scanning direction. For example, when the corrugated plates 15 and the corrugated spurs 18 and 19 are not provided and the ribs 16 are not disposed on the upper surface 14*a* of the platen 14, the recording sheet P might not be corrugated along the scanning direction. However, when the platen 14 is relatively large, it may be difficult to make the upper surface 14*a* perfectly flat. Therefore, in such a case, variations of the height or level of the upper surface 14*a* of the platen 14 along the scanning direction may cause variations of the height or level of the recording sheet P placed on the upper surface 14*a* of the platen 14 along the scanning direction. Therefore, gaps between the ink ejection surface 12*a* and the recording sheet P may fluctuate along the scanning direction. Fluctuations of the gaps may also be caused due to variations in the height or level of the upper surface 14*a* of the platen 14 along the feeding direction, and pivotal movement of the platen 14 on the pivot shaft 14*b*. For example, differences may be caused between variations of gaps between the upstream nozzles 10*a* and the recording sheet P along the scanning direction, and variations of gaps between the downstream nozzles 10*b* and the recording sheet P along the scanning direction, due to, for example, the inclination of the upper surface 14*a*. Therefore, in such a case, by determining the delay times in each pass, similar to the above-described illustrative embodiment, deviation amounts of the ink landing positions may be reduced at a joint portion between an image to be printed by the first pass and an adjacent image on the upstream side in the feeding direction and a joint portion between an image to be printed by the last pass and an adjacent image on the downstream side in the feeding direction.

The examples herein describe an inkjet printer in which gaps between the ink ejection surface 12*a* and the recording sheet P vary or fluctuate along the scanning direction. However, the disclosure is not limited thereto. For example, the features herein be applied to such an inkjet printer that does not cause variations or fluctuations of gaps between the ink ejection surface 12*a* and the recording sheet P in the scanning direction due to a high flatness of the upper surface 14*a* of the platen 14. In this case, gaps between the ink ejection surface 12*a* and the recording sheet P do not fluctuate along the scanning direction, but the upper surface 14*a* of the platen 14 may incline relative to the ink ejection surface 12*a* due to an error or tolerance of attachment of the platen 14 to the inkjet printer 1. In this case also, differences may be caused between gaps between the upstream nozzles 10*a* and the recording sheet P and gaps between the downstream nozzles 10*b* and the recording sheet P. Therefore, in such a case, by determining the delay times in each pass similar to the above-described illustrative embodiments, deviation amounts of the ink landing positions may be reduced at a joint portion between an image to be printed by the first pass and an adjacent image on the upstream side in the feeding direction and a joint portion between an image to be printed by the last pass and an adjacent image on the downstream side in the feeding direction to.

In this case, gaps between the upstream nozzles 10*a* and the recording sheet P may be approximately constant regardless of positions of the upstream nozzles 10*a* in the scanning direction. Gaps between the downstream nozzles 10*b* and the recording sheet P may be approximately constant regardless of positions of the downstream nozzles 10*b* in the scanning direction. Therefore, for example, one delay time according to the gap between the upstream nozzle 10*a* and the recording sheet P may be stored as the upstream correction information in the EEPROM 54. One delay time according to the gap between the downstream nozzle 10*b* and the recording sheet P may be stored as the downstream correction information in the EEPROM 54.

While the disclosure has been described in detail with reference to the specific embodiments thereof, this is merely an example, and various changes, arrangements and modifications may be applied therein without departing from the spirit and scope of the disclosure.

What is claimed is:

1. An inkjet printer comprising:

an inkjet head including an ink ejection surface having a nozzle array, the nozzle array having a plurality of nozzles arranged in a first direction, the plurality of nozzles include an upstream nozzle disposed on an upstream side of the nozzle array in the first direction and a downstream nozzle disposed on a downstream side of the nozzle array in the first direction, each nozzle being configured to selectivity eject ink;

a head scanning mechanism configured to position the inkjet head opposite a recording medium, and to move the inkjet head along a second direction parallel to the ink ejection surface and perpendicular to the first direction;

a feeding mechanism configured to feed the recording medium along the first direction;

a storage device configured to store upstream correction information relating to a position of the nozzle array in the second direction and an upstream correction value for ink ejection timing for ejecting ink from the nozzle array, the upstream correction value being based on a gap between an upstream nozzle of the nozzle array and the recording medium in a third direction orthogonal to the first direction and the second direction, and downstream correction information relating to the position of the nozzle array in the second direction and a downstream correction value for the ink ejection timing, the downstream correction value being based on a gap between a downstream nozzle of the nozzle array and the recording medium in the third direction; and a controller configured to:

control the inkjet head, the head scanning mechanism and the feeding mechanism to repeatedly perform a scanning operation by moving the inkjet head along the second direction and a feeding operation by feeding the recording medium along the first direction, and to print an image on the recording medium by ejecting the ink from the nozzle array during the scanning operation; and determine a correction value for a specific scanning operation by using at least one of the upstream correction information and the downstream correction information, wherein the controller is further configured to perform at least one of the following when determining the correction value for a specific scanning operation:

a first determination process for determining the correction value for the specific scanning operation by using the upstream correction information when an image is to be printed on an upstream area adjacent, on an upstream side in the first direction, to a specific area corresponding to the specific scanning operation and when no image is to be printed on a downstream area adjacent, on a downstream side in the first direction, to the specific area; and a second determination process for determining the correction value for the specific scanning operation by using the downstream correction information when no image is to be printed on the upstream area adjacent to the specific area and when an image is to be printed on the downstream area adjacent to the specific area.

2. The inkjet printer of claim 1, wherein the controller is configured to:

control the inkjet head to perform a plurality of scanning operations corresponding to one piece of the recording medium, perform the first determination process to determine a correction value for ink ejection timing for ejecting the ink from the nozzle for a first scanning operation, and perform the second determination process to determine a correction value for ink ejection timing for ejecting the ink from the nozzle for a last scanning operation.

3. The inkjet printer of claim 1, wherein the controller is further configured to perform the following when determining the correction value for the specific scanning operation: perform a third determination process to determine an average of the upstream correction value and the downstream correction value as the correction value for ink ejection timing for ejecting the ink from the nozzle for the specific scanning operation.

4. The inkjet printer of claim 1, further comprising:

an upstream wave shape generating member arranged upstream of the inkjet head in the first direction, the upstream wave shape generating member being configured to deform the recording medium in a predetermined wave shape in the second direction, the wave shape having a top portion being nearest to the ink ejection surface in the third direction and a bottom portion farthest from the ink ejection surface in the third direction, and a downstream wave shape generating member arranged downstream of the inkjet head in the first direction, the downstream wave shape generating member being configured to deform the recording medium in the predetermined wave shape.

5. The inkjet printer of claim 4, wherein the upstream correction information is determined based on fluctuation, in the second direction, of a gap between the upstream nozzle and the recording medium, and the downstream correction information is determined based on fluctuation, in the second direction, of a gap between the downstream nozzle and the recording medium.

6. An inkjet printer, comprising:

an ink jet head having a plurality of nozzles;

a head scanning mechanism configured to move the ink jet head in multiple passes in a scanning direction during an ink jet printing operation;

a feeding mechanism configured to move a print medium in a feeding direction during the ink jet printing operation; and a controller configured to perform the following:

determine whether a specified pass in the ink jet printing operation has an adjacent downstream pass having an image;

determine whether the specified pass has an adjacent upstream pass having an image;

determine whether to use an upstream correction information, a downstream correction information, or both, to calculate an ink jet timing for the specified pass based on the determinations of whether the specified pass has an adjacent downstream pass having an image and whether the specified pass has an adjacent upstream pass having an image;

calculate the ink jet timing based on the upstream correction information, downstream correction information, or both; and conduct the specified pass in the ink jet printing operation using the ink jet timing.

7. The ink jet printer of claim 6, wherein the controller is further configured to:

determine that the specified pass has an adjacent downstream pass having an image, and no adjacent upstream pass having an image, and in response:

determine a downstream correction information based on nozzle gap distance between a downstream nozzle of the ink jet head and the print medium; and use the determined downstream correction information to calculate the ink jet timing for the specified pass.

8. The ink jet printer of claim 6, wherein the controller is further configured to perform the three determining steps for a first pass of the print medium and for a last pass of the print medium.

9. The ink jet printer of claim 6, wherein the controller is further configured to:

calculate the ink jet timing for the specified pass using an upstream correction information based on nozzle gap distance that varies according to corrugation of the print medium in a scanning direction or a downstream nozzle gap distance that varies according to corrugation of the print medium in the scanning direction.

10. The ink jet printer of claim 9, further comprising first and second wave generating members positioned on opposite sides of the print medium, wherein the corrugation of the print medium in the scanning direction is caused by the first and second wave generating members.

11. The ink jet printer of claim 6, wherein the upstream correction information and downstream correction information vary in the scanning direction.

12. The ink jet printer of claim 6, wherein the controller is further configured to determine an average value of the upstream correction information and the downstream correction information, and use the average value when calculating the ink ejection timing.

13. The ink jet printer of claim 6, wherein the controller is configured to:

generate the upstream correction information by measuring a printing deviation of an upstream nozzle in the ink jet head; and generate the downstream correction information by measuring a printing deviation of a downstream nozzle in the ink jet head.

14. The ink jet printer of claim 6, wherein the controller is configured to:

generate the upstream correction information by determining an average printing deviation of a plurality of upstream nozzles in the ink jet head; and generate the downstream correction information by determining an average printing deviation of a plurality of downstream nozzles in the ink jet head.

15. A method, comprising:

determining whether a specified pass in an ink jet printing operation has an adjacent downstream pass having an image;

determining whether the specified pass has an adjacent upstream pass having an image;

determining whether to use an upstream correction information, a downstream correction information, or both, to calculate an ink jet timing for the specified pass based on the determinations of whether the specified pass has an adjacent downstream pass having an image and whether the specified pass has an adjacent upstream pass having an image;

calculating the ink jet timing based on the upstream correction information, downstream correction information, or both; and conducting the specified pass in the ink jet printing operation using the ink jet timing.

16. The method of claim 15, further comprising:

determining that the specified pass has an adjacent downstream pass having an image, and no adjacent upstream pass having an image, and in response:

determining a downstream correction information based on nozzle gap distance between a downstream nozzle of an ink jet head and a print medium; and using the determined downstream correction information to calculate the ink jet timing for the specified pass.

17. The method of claim 15, further comprising performing the three determining steps for a first pass of a print medium and for a last pass of the print medium.

18. The method of claim 15, further comprising:

calculating the ink jet timing for the specified pass using an upstream correction information based on nozzle gap distance that varies according to corrugation of a print medium in a scanning direction or a downstream nozzle gap distance that varies according to corrugation of the print medium in the scanning direction.

19. The method of claim 18, further comprising using first and second wave generating members to create the corrugation of the print medium.

20. The method of claim 15, further comprising:

determining an average value of the upstream correction information and the downstream correction information, and use the average value when calculating the ink jet timing.

* * * * *